US005801673A

United States Patent [19]

Shimada et al.

[11] Patent Number: 5,801,673

[45] Date of Patent: Sep. 1, 1998

[54] LIQUID CRYSTAL DISPLAY DEVICE AND METHOD FOR DRIVING THE SAME

[75] Inventors: Takayuki Shimada, Ikoma-gun; Toshihiro Yamashita, Nara; Yutaka Takafuji, Nara; Toshio Matsumoto, Nara, all of Japan

[73] Assignee: Sharp Kabushiki Kaisha, Osaka, Japan

[21] Appl. No.: 297,219

[22] Filed: Aug. 29, 1994

[30] Foreign Application Priority Data

Aug. 30, 1993 [JP] Japan ..... 5-214500
Nov. 30, 1993 [JP] Japan ..... 5-300537

[51] Int. Cl.[6] ..... G09G 3/34

[52] U.S. Cl. ..... 345/100; 345/197

[58] Field of Search ..... 345/100, 197, 345/198, 180

[56] References Cited

U.S. PATENT DOCUMENTS

| | | | |
|---|---|---|---|
| 2,998,192 | 8/1961 | Florida | 235/164 |
| 4,724,433 | 2/1988 | Inoue et al. | 340/805 |
| 5,173,791 | 12/1992 | Strathman et al. | 345/92 |
| 5,262,720 | 11/1993 | Senn et al. | 324/158 |
| 5,289,332 | 2/1994 | Senn et al. | 361/1 |
| 5,583,533 | 12/1996 | Moriyama | 345/94 |

FOREIGN PATENT DOCUMENTS

| | | | |
|---|---|---|---|
| 167408 | 1/1986 | European Pat. Off. | 345/100 |
| A-0 554 129 | 3/1988 | European Pat. Off. . | |
| 0304990 | 3/1989 | European Pat. Off. . | |
| 0477099 A1 | 3/1992 | European Pat. Off. . | |
| 0480819 A1 | 4/1992 | European Pat. Off. . | |
| A-0 259 875 | 8/1993 | European Pat. Off. . | |
| 622772 | 11/1994 | European Pat. Off. | 345/100 |
| 59-211087 | 11/1984 | Japan . | |
| 60-166927 | 8/1985 | Japan . | |
| 2-19456 | 5/1990 | Japan . | |
| 3185428 | 8/1991 | Japan | 345/100 |
| 5-43118 | 6/1993 | Japan . | |

OTHER PUBLICATIONS

Takahashi et al, "Multimedia Projector Using 720x480 Pixel a–Si TFT–LCDs and a High Speed Analogue Driver LSI", Displays, vol. 13, No. 1, 1992, Guildford GB, pp. 5–10.

Maekawa et al, "5.: A High–Resolution 0.7–in.–Diagonal TFT–LCD", SID 92 Digest, 1992.

*Primary Examiner*—Richard Hjerpe
*Assistant Examiner*—Vui T. Tran
*Attorney, Agent, or Firm*—Nixon & Vanderhye, P.C.

[57] ABSTRACT

A liquid crystal display device which includes: a plurality of source bus lines in parallel with each other; a plurality of gate bus lines in parallel with each other, crossing the source bus lines; a switching element connected to one of the plurality of source bus lines and one of the gate bus lines; a pixel portion connected to the switching element; and a source drive circuit for supplying a data signal to the plurality of source bus lines, wherein the source drive circuit has a data signal line connected to the respective source bus lines, and the data signal line forms a closed circuit, thereby making a delay time of the data signal supplied to the plurality of source bus lines uniform is disclosed.

24 Claims, 19 Drawing Sheets

200

202
208
204
208
B
G
204
R
210
206
204

CK
---

A1
T1

A2

A3

An

D1
D2
D3
---
T2

LIQUID CRYSTAL DISPLAY DEVICE AND METHOD FOR DRIVING THE SAME

BACKGROUND OF THE INVENTION

1. Field of the Invention

The present invention relates to a liquid crystal display device, a projection type liquid crystal display apparatus including the same, and a method for driving the same.

2. Description of the Related Art

FIG. 1 shows an example of a circuit structure on a display substrate side of a conventional active matrix type liquid crystal display device. This active matrix type liquid crystal display device has a plurality of gate bus lines 101, 101, . . . extending in parallel with each other and a plurality of source bus lines 102, 102, . . . extending in parallel with each other so as to cross each gate bus line 101 in its display region 100. Each gate bus line 101 extending outside of the display region 100 is connected to a gate drive circuit 104.

One end of each source bus line 102 extending outside of the display region 100 is connected to analog switches S', S'. . . in a source drive circuit 105. Each analog switch S' is connected to a common shift register 106 and a common data signal line 107. One electrode of each source bus line additional capacitor 108 for holding a data signal is connected to each source bus line 102 and the other electrode thereof is connected to a common source capacitor line 109.

A thin film transistor (hereinafter, referred to as TFT) 103 is provided in the vicinity of each crossed point of the gate bus line 101 and the source bus line 102 so as to be connected to both of the lines. A gate electrode of each TFT 103 is connected to the gate bus line 101, and an on/off control signal is supplied from the gate drive circuit 104 to the TFT 103 through the gate bus line 101. A source electrode of each TFT 103 is connected to the source bus line 102, and when the TFT 103 is turned on, a data signal is supplied from the source drive circuit 105 to a drain electrode side through the source bus line 102. The drain electrode of each TFT 103 is connected to a liquid crystal capacitor (hereinafter, referred to as LC capacitor) 110 and a storage capacitor 111. The LC capacitor 110, the storage capacitor 111 and the TFT 103 are included in a pixel portion. The LC capacitor 110 includes a pixel electrode (not shown), a counter electrode (not shown) facing the pixel electrode, and a liquid crystal layer (not shown) interposed between these electrodes. A display is performed by applying a voltage to the LC capacitor 110 to induce the change in electro-optic characteristics of the liquid crystal layer. One end of the LC capacitor 110 is connected to the TFT 103 and the other end thereof is grounded. One end of the storage capacitor 111 is connected to the TFT 103 and the other end thereof is connected to a storage capacitor common line 112.

Hereinafter, the operation of the above-mentioned display device will be described.

The electrical potential of one gate bus line 101 is turned high with a signal from the gate drive circuit 104. When all of the TFTs 103 connected to the gate bus line 101 are turned on, a sampling signal is output from the shift register 106 of the source drive circuit 105. The analog switches S', S'. . . are successively turned on with the sampling signal, and a data signal is successively supplied to the source bus line 102 corresponding to each analog switch S'. The data signal is supplied to the LC capacitor 110 through the drain electrode of the TFT 103, and a voltage corresponding to the difference in electrical potential between the pixel electrode and the counter electrode is applied to the liquid crystal layer.

This voltage is simultaneously applied to the storage capacitor 111. The data signal thus supplied is held by the source bus line additional capacitor 108 when the analog switch S' is turned off in accordance with the corresponding sampling signal. Furthermore, the data signal is held by the storage capacitor 111 under the condition that the electrical potential of the gate bus line 101 is turned low and the TFT 103 is turned off.

In the above-mentioned method for driving a liquid crystal display device in which a signal is held by the source bus line additional capacitor 108, a voltage applied to each LC capacitor 110 is determined based on the ratio of the capacitance of the source bus line additional capacitor 108 to that of the storage capacitor 111. For this reason, in order to minimize the fluctuation of an electrical potential when a signal is applied to the LC capacitor 110, the source bus line additional capacitor 108 is required to have a sufficiently larger capacitance than that of the storage capacitor 111.

The source bus line 102 has a parasitic capacitance including the capacitance of the LC capacitor 110. Since the LC capacitor 110 has its capacitance changed depending upon the voltage to be applied thereto, in order to secure linearity with respect to an applied voltage, the source bus line additional capacitor 108 is required to have a sufficiently larger capacitance than that of the LC capacitor 110.

Furthermore, a high-speed operation in the range of 1 $MH_Z$ to 20 $MH_Z$ is required in the source drive circuit 105. For realizing sufficient sampling characteristics with such a high speed operation, there is the following method: A period for turning on each analog switch S' is made longer than the period for sampling each source bus line 102, whereby a plurality of analog switches S' are turned on to sample a plurality of source bus lines 102 at one time. This method is performed by providing a plurality of shift registers with different phases in parallel with each other or obtaining a logical sum of outputs from the shift register 106. In the case of using this driving method, since a plurality of source bus line capacitors 108 are electrically connected to the data signal line 107, the delay of an input signal is further increased.

As described above, in the circuit configuration of a display portion of the conventional active matrix type liquid crystal display device, since the load on each source bus line 102 is large, the capacitive load on the data signal line 107 connected to the source bus line 102 is increased. This causes the delay of an input signal, leading to the decrease in resolution. This problem will be described by way of an example of a projection type liquid crystal display apparatus.

FIG. 2 shows an example of a structure of a projection type liquid crystal display apparatus 200 using three liquid crystal display panels 210. In the projection type liquid crystal display apparatus 200, collimated light emitted from a light source 202 is split into three components Red (R), Green (G), and Blue (B) through a reflective mirror 204 and dichroic mirrors 206. Light components R, G, and B are respectively incident upon three liquid crystal display panels 210 corresponding thereto. The light components R, G, and B transmitted through the liquid crystal panels 210 are combined through a total reflective mirror 204 and a half mirror 208 to provide a color image.

In the projection type liquid crystal display apparatus using three liquid crystal display panels, generally, the scanning direction of a data signal line of one of the three liquid crystal panels needs to be opposite to that of the other two panels. In the example shown in FIG. 2, the scanning direction of a data signal line of the liquid crystal display panel 210 corresponding to the light component G is required to be opposite to that of the other liquid crystal display panels 210 respectively corresponding to the light components R and B.

When a liquid crystal display device having a large signal delay in its data signal line as described above is applied to the projection type liquid crystal display apparatus, problems arise.

Since a signal delay is different to a great degree between the input side and the output side of the data signal line, the decrease in resolution, color shift, and the like occurring on one side of a screen cannot be completely corrected. This results in the decrease in image quality on both sides of the screen in the direction of the data signal line (usually, in the horizontal direction).

For example, the decrease in resolution caused by the delay of a data signal is prevented by the following general procedure:

An overshoot and an undershoot as shown in FIG. 3A are added to a waveform of an input data signal. The amount of the overshoot and the undershoot is regulated so that correct signals such as $V_n$, $V_m$, $V_{n+1}$, and $V_{m+1}$ are sampled in the source bus lines as shown in FIG. 3B.

In the case where a data signal without any compensation as shown in FIG. 4A is input, undesired data such as $V_n'$, $V_m'$, $V_{n+1}'$, and $V_{m+1}'$ are sampled in the source bus lines as shown in FIG. 4B. However, when the signal delay is different to a great degree, since the above-mentioned compensation cannot be uniformly realized, the decrease in resolution cannot be effectively prevented.

Furthermore, the conventional liquid crystal display device and method for driving the same have problems such as the deformation of a data signal and the occurrence of a ghost image.

FIG. 5 is a block diagram showing an example of the structure of a drive circuit 302 used in a conventional display device 301. FIG. 6 is a block diagram showing the structure of the display device 301. The display device 301 includes a display portion 304 having a plurality of pixel portions 303 arranged in a matrix and the drive circuit 302 for driving the display portion 304. In the display portion 304, a plurality of source bus lines 305 and a plurality of gate bus lines 306 being perpendicular to the source bus lines 305 are formed. Each pixel portion 303 of the display portion 304 has a TFT 307 connected to the source bus line 305 and the gate bus line 306, an LC capacitor 308, and a storage capacitor 309. One electrode of each storage capacitor 309 is connected to the LC capacitor 308 and the other electrode thereof is connected to a storage capacitor common line 310. Each source bus line 305 is connected to a source drive circuit 311 provided in the drive circuit 302. Each gate bus line 306 is connected to a gate drive circuit 312 provided in the drive circuit 302.

The source drive circuit 311 includes a shift register 313, a plurality of analog switches 314, and source bus line additional capacitors 315. The shift register 313 shifts a start pulse SP input in the first storage cell to the adjacent storage cell in accordance with a clock signal CR input separately from the start pulse SP. A plurality of analog switches 314 are provided between the source bus lines 305 and a data signal line 316 and sample data supplied from the data signal line 316 to be written to each source bus line 305. Each source bus line additional capacitor 315 holds data supplied to the source bus line 305. The source bus line additional capacitor 315 is provided between a source bus line additional capacitor common line 317 and the source bus line 305, and one electrode of the source bus line additional capacitor 315 is connected to the source bus line 305 and the other electrode thereof connected to the source bus line additional capacitor common line 317.

The outputs from the respective storage cells of the shift register 313 are respectively input to the corresponding analog switches 314 as a control signal for sampling. In the conventional example, the drive circuit 302 is formed together with a TFT array of the display portion 304 on an identical substrate.

Hereinafter, the operation of the display device 301 will be described.

A gate signal for driving each TFT 307 is supplied from the gate drive circuit 312 to the gate bus line 306. Under the condition that each TFT 307 associated with the gate bus line 306 is turned on with the gate signal, a data signal supplied from the source drive circuit 311 to the source bus line 305 is written in the LC capacitor 308 and the storage capacitor 309 in each pixel portion 303.

FIGS. 9A through 9F show a timing diagram illustrating the operation of the shift register 313. This timing diagram is referred to in the conventional example as well as in a part of examples described later. FIG. 9A shows the clock signal CK supplied to the shift register 313; sampling signals $A_1$ through $A_n$ of FIGS. 9B through 9E are outputs from the respective storage cells of the shift register 313; and FIG. 9F shows data supplied to the data signal line 316.

As shown in FIGS. 9A through 9F, the start pulse SP input in the first storage cell of the shift register 313 is shifted to the subsequent storage cell in accordance with a rise timing of the clock signal CK. In the conventional example, an output pulse length T1 of each storage cell is twice the period T2 allocated to sampling of the corresponding source bus line 305.

In the case where a usual display is performed, data written in the adjacent source bus lines 305 have high correlation. Thus, a data signal is substantially precharged in each source bus line 305 by setting the period T1 longer than the period T2. Because of this, the parasitic capacitance of the source bus lines 305 and the write characteristics of a data signal written in the source bus line additional capacitor 315 of each source bus line 305 can be improved. Particularly, in a display device with high definition, the source bus lines increase in number in each display device to cause high density. This shortens the period allocated for sampling of each source bus line 305. For this reason, the conventional example has a structure effective for the improvement of a display quality. A data signal sampled by the analog switch 314 is held by the source bus line additional capacitor 315 of the source bus line 305, during which the data signal is written in the LC capacitor 308.

However, as described in Japanese Patent Publication No. 5-43118, according to the conventional structure, the load connected to the source bus lines 305 increases, resulting in the deformation of the waveform of a data signal as well as the decrease in resolution in the display device 301. In general, the data signal line 316 has a capacitance with respect to the gate of the analog switch 314 of each source bus line 305, an interline capacitance, and the source bus line additional capacitance 315 provided at the selected source bus line 305.

The ratio among these capacitances is changed depending upon the number of source bus lines 305, the capacitance of the source bus line additional capacitor 315 of each source bus line 305, etc. In general, the capacitance of the source bus line additional capacitor 315 provided at the selected source bus line 305 plays a substantial role in determining the ratio of magnitude. As in the conventional structure, in the case where the period during which each analog switch 314 is turned on is twice the period for sampling each source bus line 305, two analog switches 314 among the analog switches 314 connected to one data signal line 316 are simultaneously turned on. For this reason, the capacitive load on the data signal line 316 caused by the source bus line additional capacitors 315 becomes double, and hence the time constant of signal transmission becomes about double. As a result, the waveform of a signal is deformed to a great degree, leading to the deterioration of resolution of an image displayed by the display device 301.

As a drive circuit for preventing flickering, those inverting the polarity of a data signal for each gate bus line 306 have been used. Such a drive circuit has the following problems:

Hereinafter, the analog switches 314 will be indicated by $A_1, A_2, A_3, \ldots$, respectively. Referring to FIGS. 9A through 9F, first, the analog switch $A_1$ is opened (ON state), and then the analog switch $A_2$ is opened. This timing is controlled by the clock signal CK input to the shift register 313. At the subsequent timing, the analog switch $A_1$ is closed (OFF state), and the analog switch $A_3$ is simultaneously opened. Thus, in the display device 301, the adjacent two analog switches 314 are opened at all times.

Data is written in the source bus line 305 connected to a certain analog switch $A_k$ as follows:

First, the analog switch $A_k$ is opened while an analog switch $A_{k-1}$ is opened, and the analog switch $A_k$ starts sampling data $D_{k-1}$ to be written in the source bus line 305 to which the analog switch $A_{k-1}$ is connected.

At the subsequent timing, the analog switch $A_{k-1}$ is closed and the analog switch $A_{k+1}$ is opened. At this timing, data $D_k$ to be written in the analog switch $A_k$ is transmitted from the data signal line 316 to the corresponding analog switch 314. The analog switch 314 starts sampling the data $D_k$. In this case, in addition to the problem of increasing the capacitances of the source bus line additional capacitors 315 held by the source bus lines 305, problems as described below will arise.

As described above, in the case of using the conventional example, the polarity of a data signal is inverted per frame for preventing flickering. Thus, a data signal with a polarity opposite to the electrical potential of the data signal line 16 is written in the source bus line 305 before the analog switch 314 is opened. This results in a very large electrical potential difference between the source bus lines 305 and the data signal line 316. Thus, a large current is required for precharging the subsequent source bus line 305 in the sampling period of a certain source bus line 305. Therefore, a waveform of a data signal to be written is further deformed.

Particularly in the case of a panel sampling hold system in which a data signal is held in the parasitic capacitance of the source bus line 305 and the corresponding source bus line additional capacitor 315, a larger capacitive load is applied to the data signal line 316, compared with a system in which an output such as a source follower is output to the source bus line 305. Thus, in this case, the problem of the deformation of the waveform of a data signal becomes more serious. In the case of a display device in which the drive circuit 302 is formed together with a TFT array of the display portion 304 on an identical substrate, the size of the drive circuit 302 becomes the same as that of the display portion 304, resulting in longer wiring length. Accordingly, the problems such as the deformation of the waveform of a data signal caused by the wiring resistance and the parasitic capacitance become serious.

There is another problem with the conventional example. That is, a data signal to be written in a certain source bus line 305 is affected by a data signal on the source bus line 305 positioned after one source bus line 305 from the certain source bus line 305, causing a so-called ghost image.

FIG. 7 is a block diagram of a drive circuit in the conventional example, for illustrating the above-mentioned phenomenon. Here, the kth source bus line 305 is exemplified. Referring to FIGS. 9A through 9F, the fall of the sampling signal $A_k$ is synchronized to the rise of the sampling signal $A_{k+2}$ in the drive timing. However, in reality, the deformation of the waveform of a data signal is caused between the fall of the sampling signal $A_k$ and the rise of the sampling signal $A_{k+2}$. In this case, when the (k+2)th analog switch 314 is turned on, the (k+2)th source bus line 305 is connected to the data signal line 316. The data on the (k+2)th source bus line 305 is the one corresponding to the (k+2)th source bus line 305 in the previous horizontal scanning period. The electrical potential of the data signal line 316 corresponds to the kth source bus line 305 in the present horizontal scanning period.

The (k+2)th analog switch 314 is turned on, and a local electrical potential for the data signal line 316 is affected by data corresponding to the (k+2)th source bus line 305 in the previous horizontal scanning period. This causes noise In data sampled in the kth source bus line in the present horizontal scanning period. In an actual display, this noise occurs as a ghost phenomenon to deteriorate the image quality.

FIG. 8 is a block diagram showing a structure for another conventional liquid crystal display device 301*a* disclosed by Japanese Patent Publication No. 2-19456. The liquid crystal display device 301*a* is similar to the above-mentioned display device 301. Thus, the identical components bear the reference numerals identical therewith. In the liquid crystal display device 301*a*, a plurality of gate bus lines 306 and a plurality of source bus lines 305 are formed in a matrix. At each crossed section, a TFT 307, a storage capacitor 309 for holding a signal to be written by the TFT 307, and an LC capacitor 308 provided in parallel with the storage capacitor 309 are provided. The LC capacitor 308 includes a liquid crystal layer between facing substrates respectively having pixel electrodes and a counter electrode. One electrode of each storage capacitor 308 is set to have the same electrical potential as that of the counter electrode through a storage capacitor common line 317.

A signal for controlling the on/off of each TFT 307 is supplied from the gate drive circuit 311 to each gate bus line 306. The source drive circuit 311 includes three data signal lines 316*a*, 316*b*, and 316*c* to which a data signal or the like is supplied, analog switches 314 for sampling each data signal on the data signals 316*a* to 316*c* to write the data signal in the source bus lines 305, and a shift register 313 for outputting a sampling signal to each analog switch 314. The data signal written in each source bus line 305 by the source drive circuit 311 is held by a parasitic capacitance of the source bus line 305 and the source bus line additional capacitor 315.

The above-mentioned liquid crystal display device 301*a* is driven as follows:

A data signal is written in each source bus line 305 by the source drive circuit 311 while one gate bus line 306 is selected by the gate drive circuit 312. The data signal written in each source bus line 305 is written in each pixel portion 303 while this gate bus line 306 is selected. In the source drive circuit 311, one sampling signal output from the shift register 313 simultaneously controls an on/off of three analog switches 314.

In the above-mentioned structure, each data signal supplied to three data signal lines 316*a* to 316*c* is required to be phase-shifted from each other. Because of this shift, a period for the analog switch 314 to sample a data signal becomes three times as long as the sampling period by each source bus line 305, and the drive frequency of the clock signal CK input to the shift register 313 becomes ⅓. Thus, a data write processing can be easily performed by the source drive circuit 311.

In the above structure, the polarity of three data signals simultaneously written in three data signal lines 16*a*, 16*b*, and 16*c* are the same. In this case, in order to sufficiently write a charge corresponding to a data signal in the source bus line additional capacitor 315 of each source bus line 305, a time constant of the source bus line capacitor common line 317 is required to be sufficiently smaller, compared with a period required for writing the data signal. At present time, this is a difficult condition to satisfy. Thus, in most cases, the delay of a signal caused by large time constant of the source bus line additional capacitor common line 317 deteriorates display characteristics of the liquid crystal display device 301*a*.

In particular, in a liquid crystal display device with high definition such as that including 1000 or more of pixels in the horizontal direction, the influence of the above-mentioned signal delay has been great.

Furthermore, in order to sufficiently write a data signal in each pixel portion 303 in the TFT array, the time constant of a signal delay of a storage capacitor common line 310 is required to be sufficiently smaller, compared with the period required for writing the data signal. At the present time, this condition is difficult to satisfy. In particular, in a liquid crystal display device with high definition as described above, the influence of this signal delay is great. Thus, decreasing the resistance of the wiring becomes one of the important techniques for high definition of the display device.

For example, assuming that the number of source bus lines from which a data signal is sampled at a time is 4; a period allocated for sampling of one column of source bus line 305 is 25 μsec; and the number of pixels in one row is N, a period Td for the additional capacity common line 317 of each source bus line additional capacitor 315 to discharge a signal written in the source bus line additional capacitor 315 is represented by the following formula (1):

$$Td=(25(\mu sec)\times 4)/(N\times 4.6(99\%\ \text{charge}))=22/N(\mu sec) \quad (1)$$

Assuming that the capacitance of the storage capacitor 309 connected to the storage capacitor common line 310 on one source bus line 305 is 4 pf; a pixel pitch in the row direction is 30 μm; a line width of wiring such as the storage capacitor common line 310 is 100 μm, and the sheet resistance is 0.1 Ω, a time constant τ of the storage capacitor common line 310 calculated by using a CR (capacitance and resistance) is represented by the following Formula (2):

$$\begin{aligned}\tau &= (4\times NpF)\times\{(30\,\mu m/100\,\mu m)\times(0.1\,\Omega\times N)\} \quad (2)\\ &= N^2\times 0.12\ \text{psec}\end{aligned}$$

For sufficiently writing a data signal in each pixel portion 303, the relationship Td>τ is required to be satisfied. A rough estimate will be as N<600. Accordingly, in particular, in a liquid crystal display device including more than 600 pixel portions in one row, the problem of a signal delay becomes serious. This problem can be overcome, for example, by further increasing the width of each line. However, the increased width of each line enlarges the device itself, leading to a high cost.

Furthermore, in the case where a display is performed by a polarity inversion drive method shown in the conventional example as disclosed in Japanese Patent Publication No. 5-43118, when pixel electrodes adjacent to each other with the source bus line 305 interposed therebetween are short-circuited, electric charges with different polarities are canceled, voltage is decreased, and a group of bright points or black points are caused in two pixels due to the current leakage between the adjacent pixel electrodes.

SUMMARY OF THE INVENTION

The liquid crystal display device of the present invention, includes: a plurality of source bus lines in parallel with each other; a plurality of gate bus lines in parallel with each other, crossing the source bus lines; a switching element connected to one of the plurality of source bus lines and one of the plurality of gate bus lines; a pixel portion connected to the switching element; and a source drive circuit for supplying a data signal to the plurality of source bus lines, wherein the source drive circuit has a data signal line connected to the respective source bus lines, and the data signal line forms a closed circuit, thereby making a delay time of the data signal supplied to the plurality of source bus lines uniform.

In one embodiment of the present invention, each of the plurality of source bus lines has a source bus line additional capacitor, and the data signal supplied to each source bus line by the source drive circuit is held by the source bus line additional capacitor and a parasitic capacitance of the source bus line.

In another embodiment of the present invention, the source drive circuit includes a shift register for sequentially outputting a sampling signal based on a clock signal supplied through a clock signal line and a plurality of sampling means for sampling a data signal based on the sampling signal to output the sampled data signal to each of the plurality of source bus lines, the respective source bus line additional capacitors are connected to a source bus line additional capacitor common line, and the clock signal line and the source bus line additional capacitor common line form closed circuits.

In still another embodiment of the present invention, a scanning direction of the shift register is changed between a forward direction and a reverse direction.

In still another embodiment of the present invention, at least two sampling means of the plurality of sampling means are turned on during an identical period.

In still another embodiment of the present invention, the above-mentioned liquid crystal display device further includes means for adding an overshoot to a rising edge of a waveform of the data signal and an undershoot to a falling edge of the waveform of the data signal.

In still another embodiment of the present invention, the above-mentioned liquid crystal display device further includes means for adjusting a phase difference between the data signal and the clock signal.

Alternatively, the projection type liquid crystal display apparatus of the present invention includes: a light source;

three liquid crystal display devices; a first optical system for splitting light from the light source into three primary-color components to introduce the three primary-color components into the three liquid crystal display devices; and a second optical system for combining the respective components transmitted through the three liquid crystal display devices, each of the three liquid crystal display devices including: a plurality of source bus lines in parallel with each other; a plurality of gate bus lines in parallel with each other, crossing the plurality of source bus lines; a switching element connected to one of the plurality of source bus lines and one of the plurality of gate bus lines; a pixel portion connected to the switching element; and a source drive circuit for supplying a data signal to the plurality of source bus lines, the source drive circuit including a data signal line connected to the respective source bus lines and a shift register for sequentially outputting a sampling signal based on a clock signal supplied through a clock signal line and a plurality of sampling means for sampling a data signal based on the sampling signal to output the sampled data signal to each of the plurality of source bus lines, wherein the data signal line forms a closed circuit, thereby making a delay time of the data signal supplied to the plurality of source bus lines uniform, and a scanning direction of the shift register is changed between a forward direction and a reverse direction, and the scanning direction of one of the three liquid crystal display devices being opposite to the scanning direction of the other liquid crystal display devices.

Alternatively, the liquid crystal display device of the present invention includes: a plurality of source bus lines in parallel with each other; a plurality of gate bus lines in parallel with each other, crossing the source bus lines; a switching element connected to one of the plurality of source bus lines and one of the plurality of gate bus lines; a pixel portion connected to the switching element; and a source drive circuit for supplying a data signal to the plurality of source bus lines, wherein the source drive circuit includes a shift register for sequentially outputting a sampling signal and a plurality of sampling means for sampling the data signal based on the sampling signal to output the sampled data signal to each of the plurality of source bus lines, the source drive circuit includes a data line branched into a first branch line and a second branch line, the plurality of sampling means being grouped into a first group connected to the first branch line and a second group connected to the second branch line, and each of the sampling means belonging to the same group is turned on during a different period.

In one embodiment of the present invention, each of the plurality of source bus lines has a source bus line additional capacitor, and the data signal supplied to each source bus line by the source drive circuit is held by the source bus line additional capacitor and a parasitic capacitance of the source bus line.

In another embodiment of the present invention, the data line further includes a third branch line, and the plurality of sampling means have the first group, the second group, and a third group connected to the third branch line.

In still another embodiment of the present invention, the plurality of sampling means belonging to different groups are turned on during an identical period.

In still another embodiment of the present invention, the source drive circuit supplies data signals with polarity alternately inverted for each gate bus line.

In still another embodiment of the present invention, the plurality of source bus line additional capacitors are connected to a source bus line additional capacitor common line, the source bus line additional capacitor common line having first and second branch source bus line additional capacitor common lines, and the plurality of source bus lines have a first group connected to the first branch source bus line additional capacitor common line and a second group connected to the second branch source bus line additional capacitor common line.

In still another embodiment of the present invention, the number of the groups of the sampling means is the same as the number of the groups of the source bus lines, and the source bus lines belonging to different groups are connected to the sampling means belonging to different groups.

According to another aspect of the present invention, the method for driving a liquid crystal display device includes: a plurality of source bus lines in parallel with each other; a plurality of gate bus lines in parallel with each other, crossing the source bus lines; a switching element connected to one of the plurality of source bus lines and one of the plurality of gate bus lines; a pixel portion connected to the switching element; and a source drive circuit for supplying a data signal to the plurality of source bus lines, wherein the source drive circuit includes a shift register for sequentially outputting a sampling signal and a plurality of sampling means for sampling the data signal based on the sampling signal to output the sampled data signal to each of the plurality of source bus lines, an even number of sampling means simultaneously samples the data signal based on one sampling signal, thereby generating an even number of sampled data signals, and the even number of sampled signals are output to the plurality of source bus lines under a condition that polarity of half of the data signals of the even number of sampled data signals are made opposite to polarity of the other half of the data signals of the even number of sampled data signals.

In one embodiment of the present invention, each of the plurality of source bus lines has a source bus line additional capacitor, and the data signal supplied to each source bus line by the source drive circuit is held by the source bus line additional capacitor and a parasitic capacitance of the source bus line, and the source bus line additional capacitors of the source bus lines connected to the even number of sampling means for simultaneously sampling based on the one sampling signal are connected to the same source bus line additional capacitor common line.

In another embodiment of the present invention, a combination of the polarity of the half of the data signals of the even number of data signals simultaneously sampled based on the one sampling signal and the polarity of the other half of the data signals of the even number of data signals is selected based on the number of defects caused in adjacent pixels.

In still another embodiment of the present invention, a combination of the polarity of the half of the data signals of the even number of data signals simultaneously sampled based on the one sampling signal and the polarity of the other half of the data signals of the even number of data signal is the same with respect to all of the sampling signals.

In still another embodiment of the present invention, a combination of the polarity of the half of the data signals of the even number of data signals simultaneously sampled based on the one sampling signal and the polarity of the other half of the data signals of the even number of data signals is selected based on the number of defects caused in adjacent pixels per sampling signal.

In still another embodiment of the present invention, the liquid crystal display device is a monochromic display device.

In still another embodiment of the present invention, the number of the plurality of pixels connected to each of the plurality of gate bus lines in the liquid crystal display device is at least 600.

Thus, the invention described herein makes possible at least one of the advantages of (1) providing a display device with a reduced signal delay; (2) providing a display device in which the deformation of the waveform of a data signal and the occurrence of a ghost phenomenon are prevented; and (3) providing a display device in which a group of bright points or black points in a display are prevented and the image quality is much improved, and a method for driving the same.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings. It is noted that the present invention is not limited to these examples.

EXAMPLE 1

Figure 10:
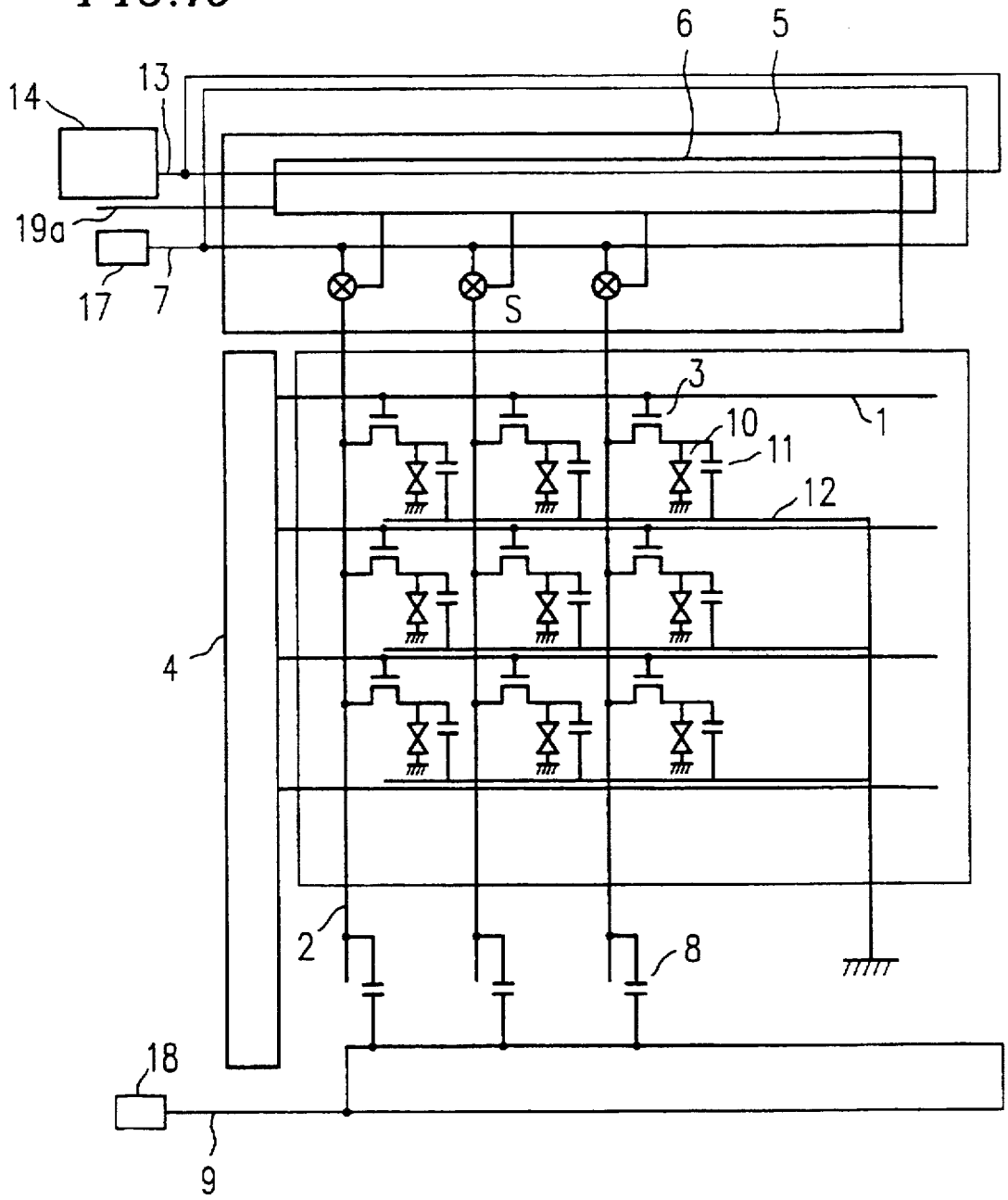
FIG. 10 is a diagram showing a circuit structure for a display substrate side of an active matrix type liquid crystal display device in Example 1 according to the present invention.

FIG. 10 shows a circuit configuration for a display substrate side of an active matrix type liquid crystal display device in Example 1 according to the present invention.

A TFT 3 is provided in the vicinity of each crossed point of a gate bus line 1 and a source bus line 2 so as to be connected to both of the lines. A gate electrode of each TFT 3 is connected to the gate bus line 1, and an on/off control signal is supplied from a gate drive circuit 4 to the TFT 3 through the gate bus line 1. A source electrode of each TFT 3 is connected to the source bus line 2, and when the TFT 3 is turned on, a data signal is supplied from a source drive circuit 5 to a drain electrode side through the source bus line 2. A drain electrode of each TFT 3 is connected to an LC capacitor 10 and a storage capacitor 11. The LC capacitor 10 and the storage capacitor 11 are included in a pixel portion. The LC capacitor 10 includes a pixel electrode (not shown), a counter electrode (not shown) facing the pixel electrode, and a liquid crystal layer (not shown) interposed between these electrodes. A display is performed by applying a voltage to the LC capacitor 10 to induce the change in electro-optic characteristics of the liquid crystal layer. One end of the LC capacitor 10 is connected to the TFT 3 and the other end thereof is grounded. One end of the storage capacitor 11 is connected to the TFT 3 and the other end thereof is connected to a storage capacitor common line 12.

Hereinafter, the operation of the above-mentioned display device will be described.

The electrical potential of one gate bus line 1 is turned high with a signal from the gate drive circuit 4. When all of the TFTs 3 connected to the gate bus line 1 are turned on, a sampling signal is output from a shift register 6 of the source drive circuit 5. Analog switches S, S . . . are successively turned on with the sampling signal, and a data signal is sequentially supplied to the source bus line 2 corresponding to each analog switch S. The data signal is supplied to the LC capacitor 10 through the drain electrode of the TFT 3, and a voltage corresponding to the difference in electrical potential between the pixel electrode and the counter electrode is applied to the liquid crystal layer. This voltage is simultaneously applied to the storage capacitor 11. The data signal thus supplied is held by a source bus line additional capacitor 8 when the analog switch S is turned off in accordance with the corresponding sampling signal. Furthermore, the data signal is held by the storage capacitor 11 under the condition that the electrical potential of the gate bus line 1 is turned low and the TFT 3 is turned off.

In the active matrix type liquid crystal display device in Example 1, as shown in FIG. 10, the data signal line 7 connected to a data signal generating circuit 17 constitutes a closed-circuit, and a clock signal line 13 connected to a clock signal generating circuit 14 and supplying a clock signal to the shift register 6 included in the source drive circuit 5 constitutes a closed-circuit. This enables a data signal or a clock signal to be input from both of the first positioned and last positioned source bus lines. A scanning direction of the shift register 6 can be switched between a forward direction and a reverse direction in accordance with a switching signal 19*a*. In the case where a plurality of clock signal lines 13 are provided, each clock signal line 13 constitutes a closed-circuit.

A source bus line additional capacitor common line 9, which is connected to a common electrode signal generating circuit 18, also constitutes a closed-circuit, enabling a common electrode signal to be input from both sides of the display.

Owing to the above-mentioned circuit structure, the distribution of a delay time of signal inputs supplied to the source bus lines 2 is minimized, and the difference of the delay time on a right side of a screen and that on a left side of the screen is suppressed. As a result, the problem of a color shift on both sides of the screen caused by the difference of the delay time of a signal input on both sides of the screen is overcome, and a satisfactory image can be obtained, unlike the conventional projection type liquid crystal display apparatus using three liquid crystal display panels.

In addition, a projected image can be improved by performing a minute control, i.e., controlling a phase difference between a data signal and a clock signal per panel in the projection type liquid crystal display apparatus. By controlling a delay time of the clock signal, the phase difference between the data signal and the clock signal is compensated to almost completely prevent the delay of a data signal input from the data signal line 7. As a result, the image quality of the display device of the present example is further improved. The control of the phase difference between the data signal and the clock signal can be conducted by providing a delay circuit (not shown) in a clock signal generating circuit 14.

Figure 1:
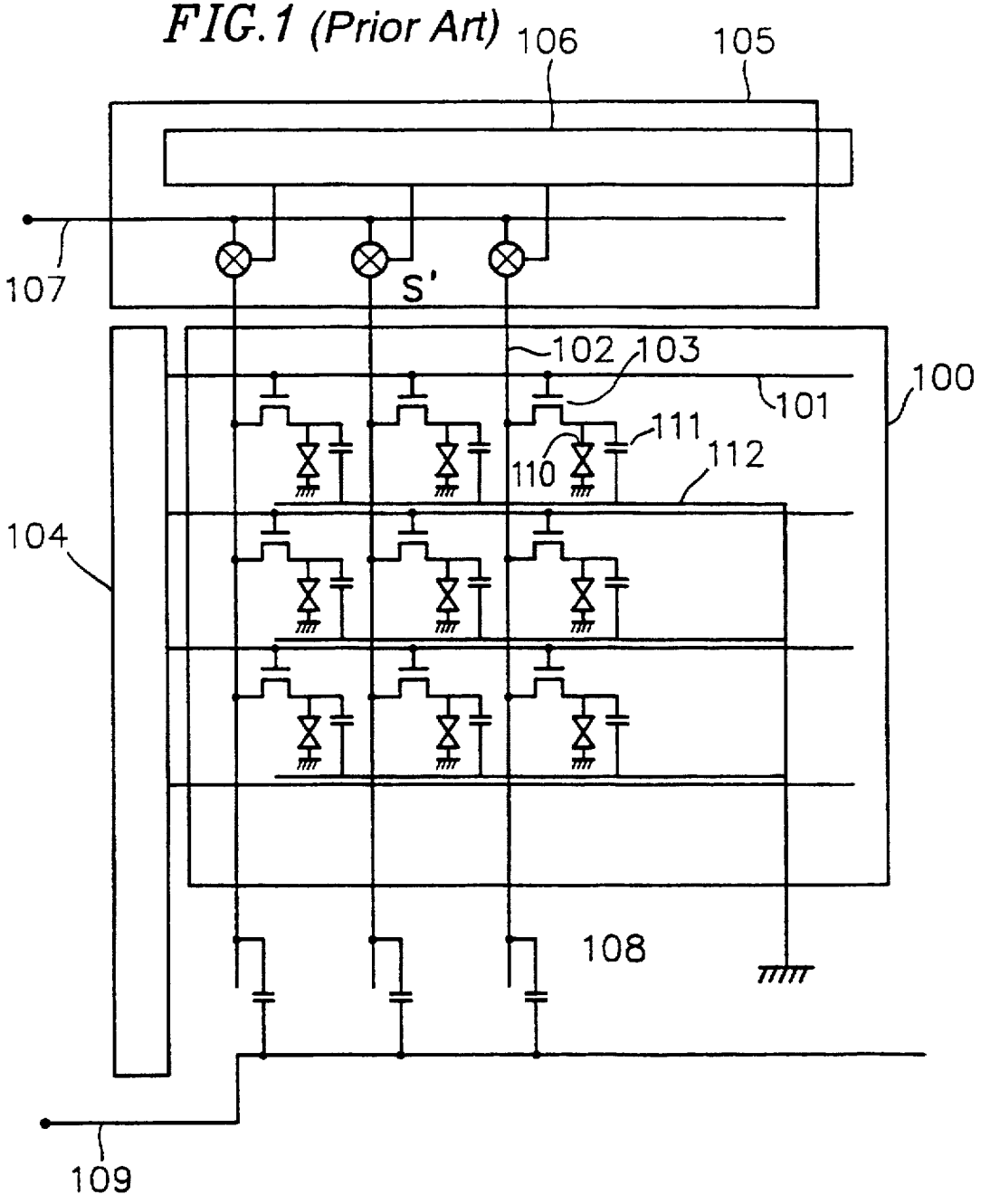
FIG. 1 (Prior Art)
FIG. 1 shows a circuit structure for a display substrate side of a conventional active matrix type liquid crystal display device.
Figure 2:
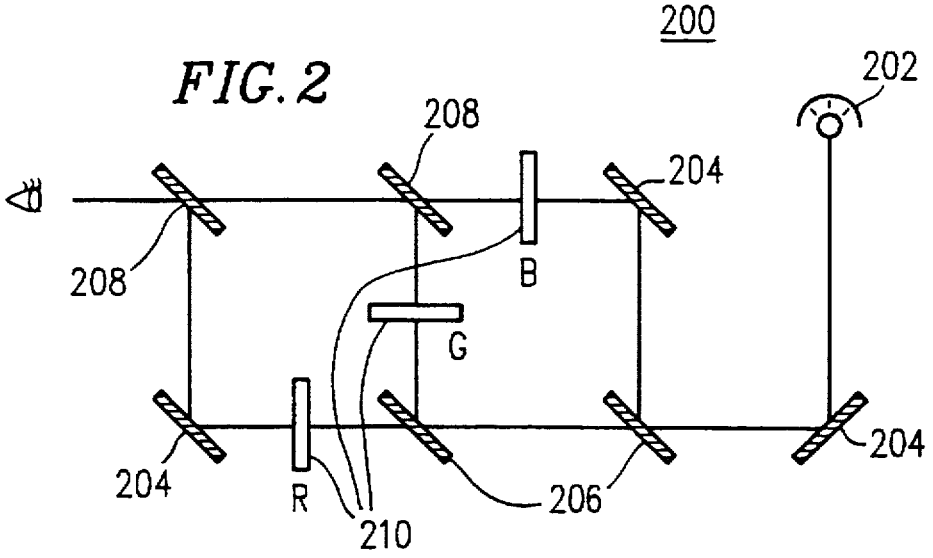
FIG. 2 schematically shows an exemplary structure of a projection type liquid crystal display apparatus using thee liquid crystal display panels.
Figure 3A:
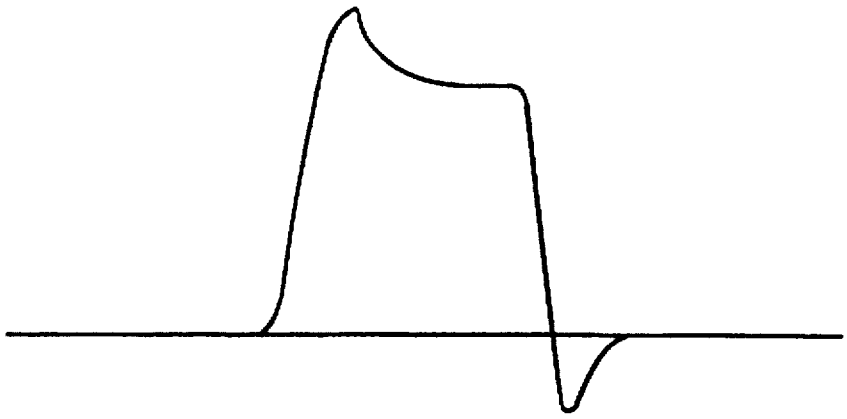
FIG. 3A shows a waveform for an input data signal with an overshoot and an undershoot added.
Figure 3B:
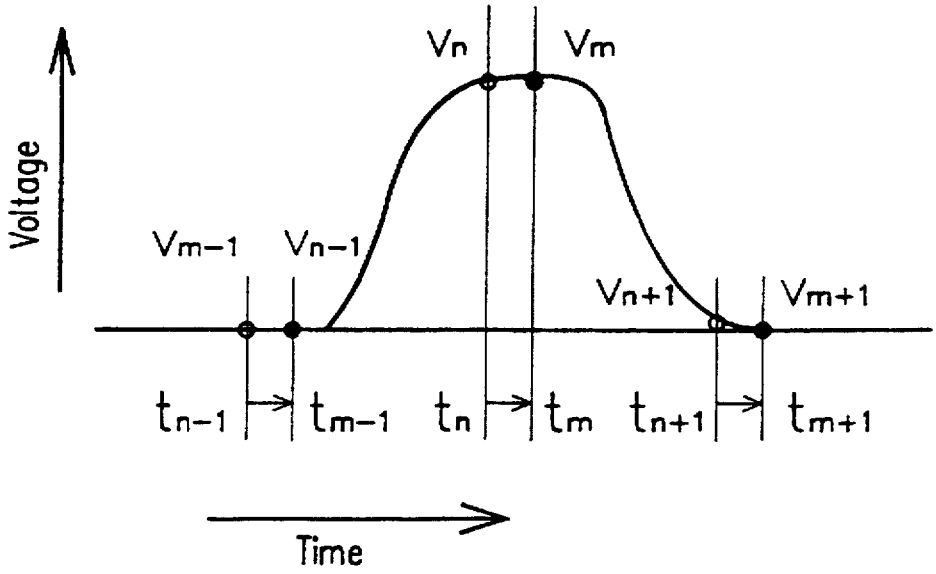
FIG. 3B shows a waveform of the input data signal of FIG. 3A in a source bus line.
Figure 4A:
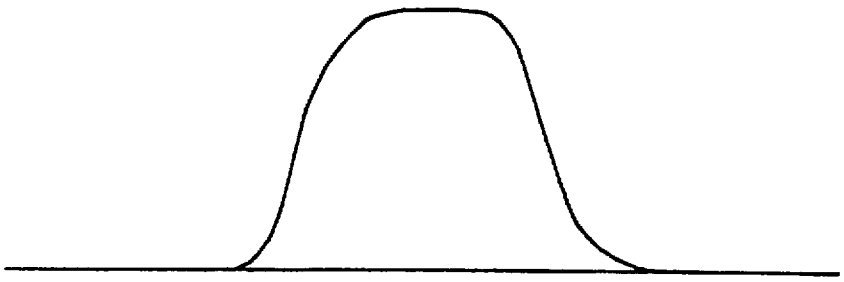
FIG. 4A shows a waveform for a normal input data signal.
Figure 4B:
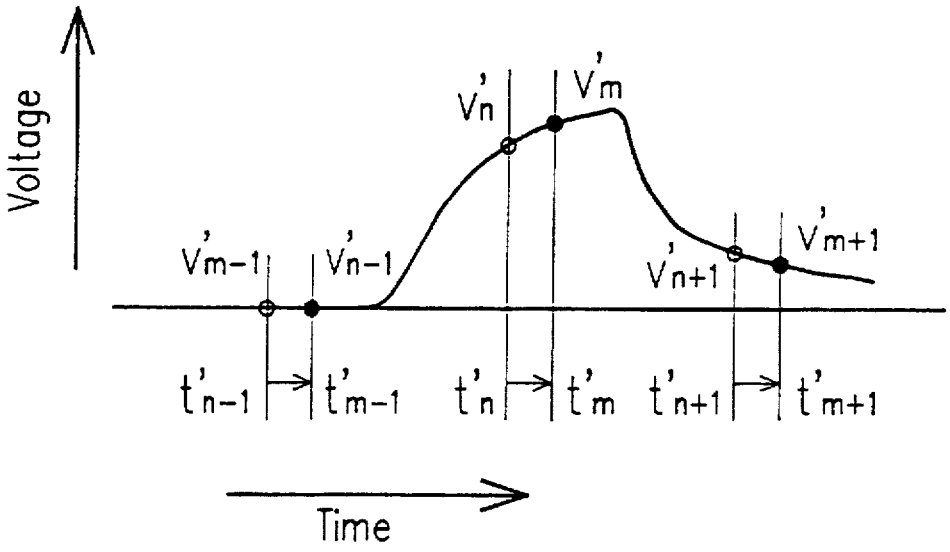
FIG. 4B shows the waveform of the input data signal of FIG. 4A in a source bus line.
Figure 5:
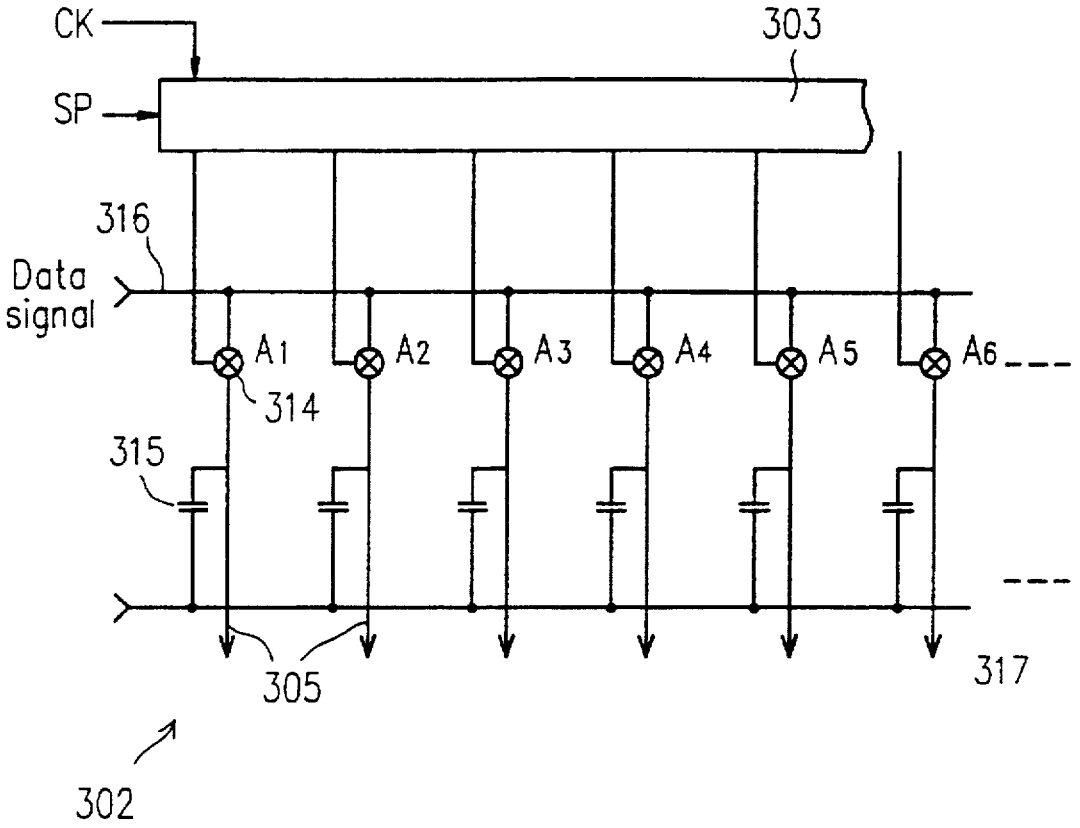
FIG. 5 (Prior Art)
FIG. 5 is a block diagram showing an exemplary configuration for a drive circuit used in a conventional liquid crystal display device.
Figure 6:
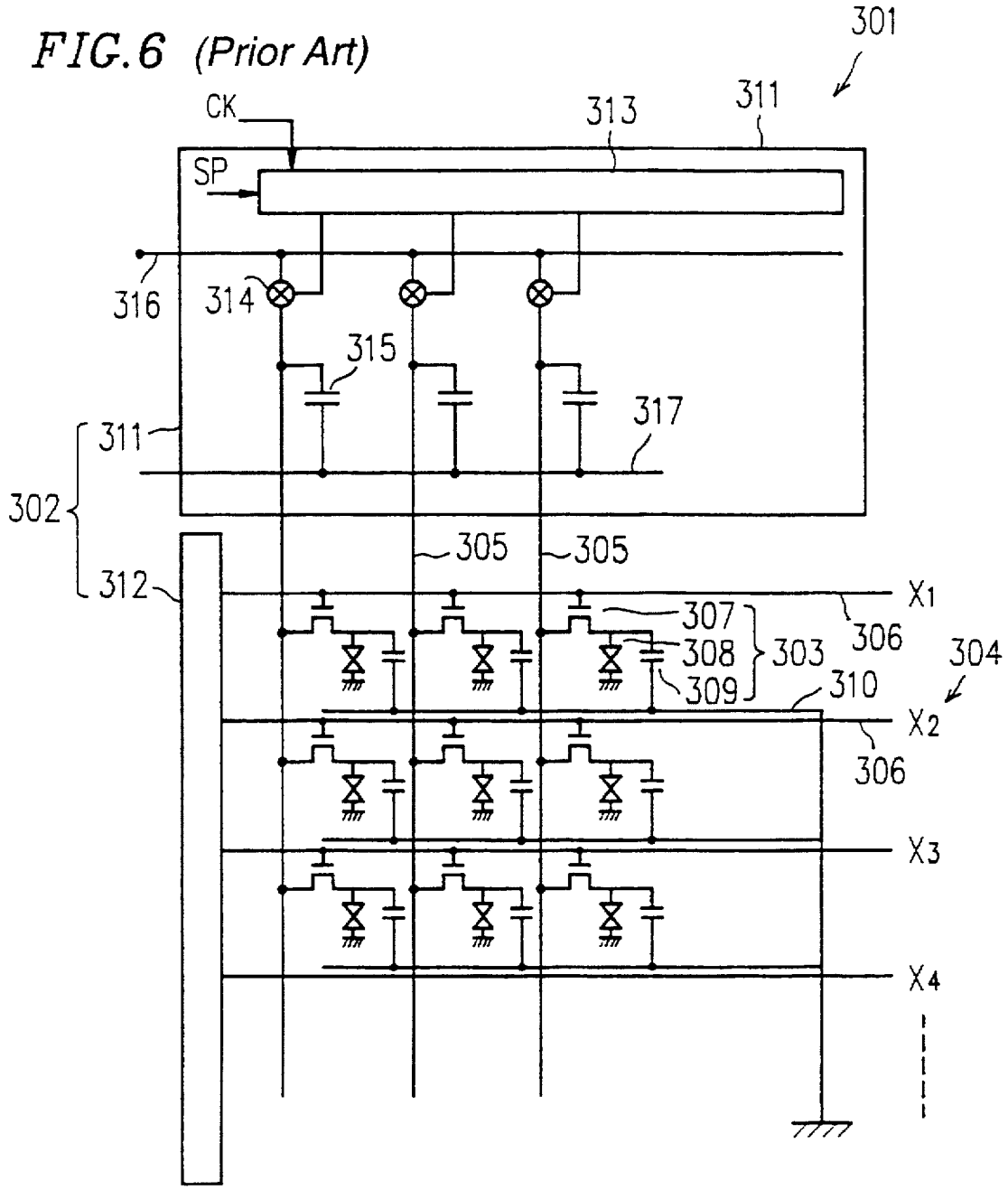
FIG. 6 (Prior Art)
FIG. 6 is a block diagram of the conventional liquid crystal display device.
Figure 7:
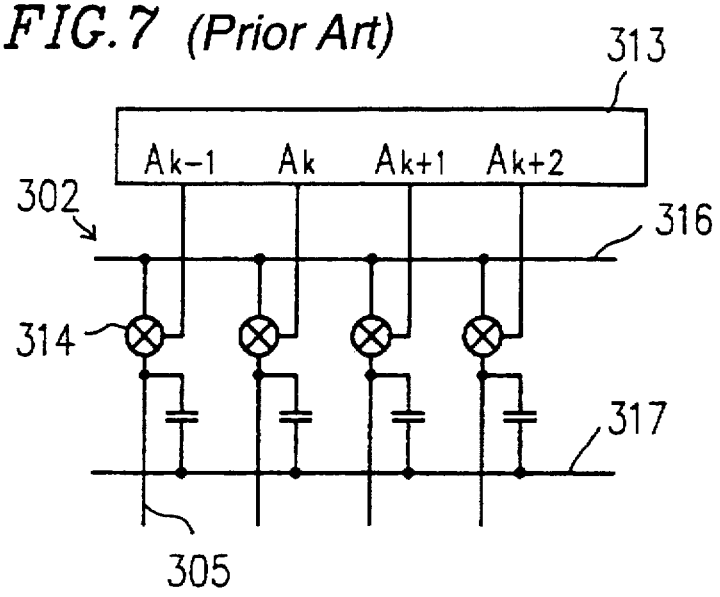
FIG. 7 (Prior Art)
FIG. 7 is a block diagram of a conventional drive circuit, illustrating a ghost phenomenon.
Figure 8:
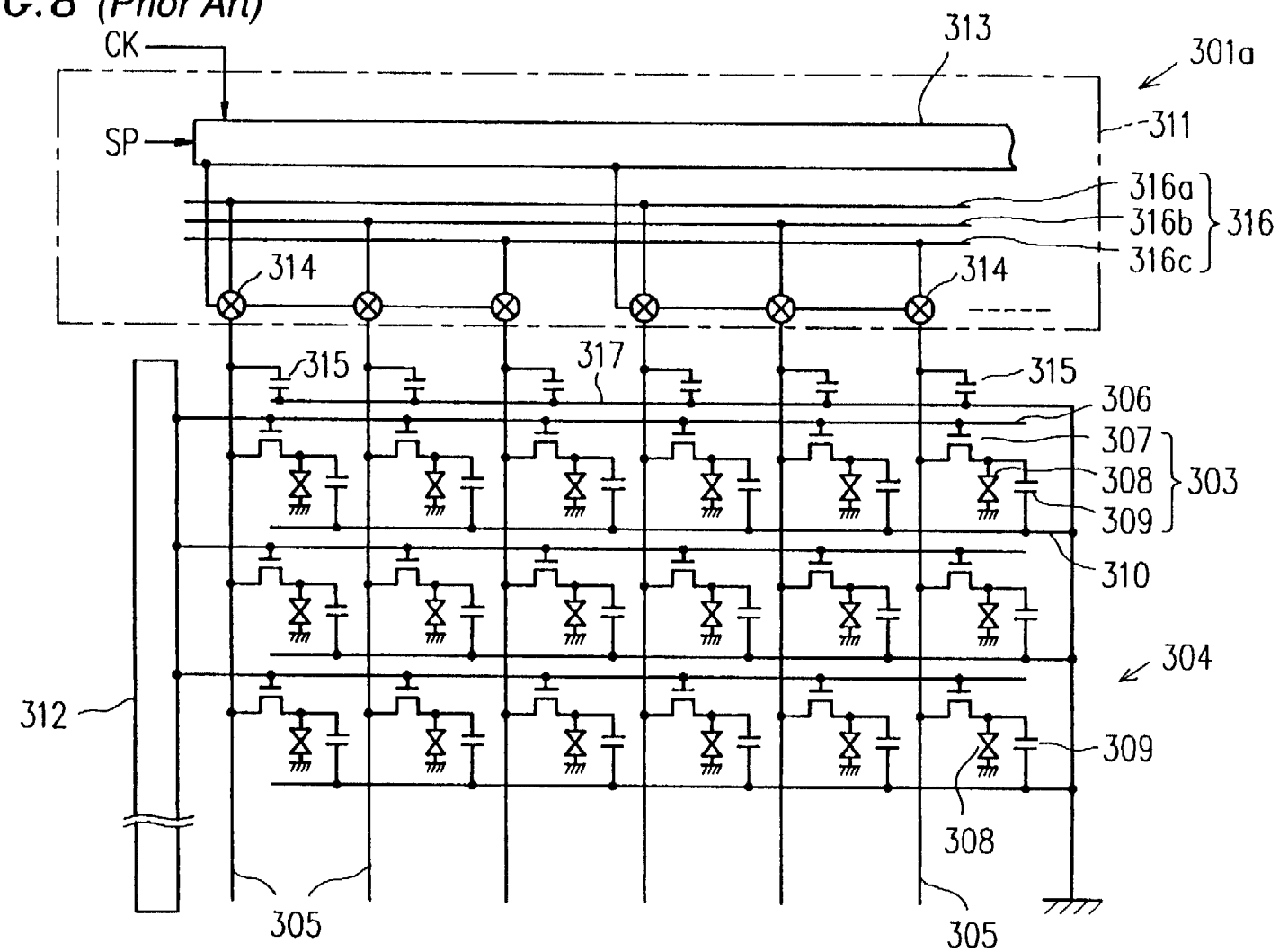
FIG. 8 (Prior Art)
FIG. 8 is a block diagram showing a structure for another conventional liquid crystal display device.

Furthermore in Example 1, an overshoot and an undershoot are added by the data signal generating circuit 17 to portions of a waveform of a data signal where the amplitude is rapidly changed. The amplitude of the overshoot and the undershoot are controlled so as to obtain a desired waveform. More specifically, an 30 overshoot and an undershoot as shown in FIG. 4A are added to a waveform of a data signal so that correct signals such as $V_n$, $V_m$, $V_{n+1}$, and $V_{m+1}$, are sampled as shown in FIG. 4B. Therefore, the decrease in resolution can be suppressed and a display with high quality is obtained.

When the active matrix type liquid crystal display device in Example 1 was used as a display device for an HDTV having a diagonal size of about 2 inches and 1472 source bus lines, satisfactory result such as a delay time of about 10 nsec was obtained. In addition, the color shift and decrease in resolution were not caused.

As described above, in the active matrix type liquid crystal display device in Example 1, the data signal line 7, the clock signal line 13, and the source bus additional capacitor common line 9 are capable of supplying a signal from both sides thereof. Because of this structure, the delay of a signal input on both sides of a screen can be minimized. As a result, a color shift in an image caused by the delay of an input signal is prevented to substantially improve the image quality. The influence of the delay is also alleviated by controlling a phase difference between a data signal to be input and a clock signal from the shift register 6, whereby the image quality is further improved. When this type of display device is applied to the projection type liquid crystal display apparatus using three liquid crystal display panels, a color shift caused by the delay of a signal input can be prevented.

Furthermore, in Example 1, an overshoot is added to a rising edge of a waveform of a data signal and an undershoot is added to a falling edge thereof. This enhances the effect of the above-mentioned phase control. As a result, a high quality image can be realized without the decrease in resolution such as a ghost image which has not been avoided on one side of a screen of a conventional display device.

The effects of Example 1 are particularly great in a high definition panel with a great number of pixels.

EXAMPLE 2

Figure 11:
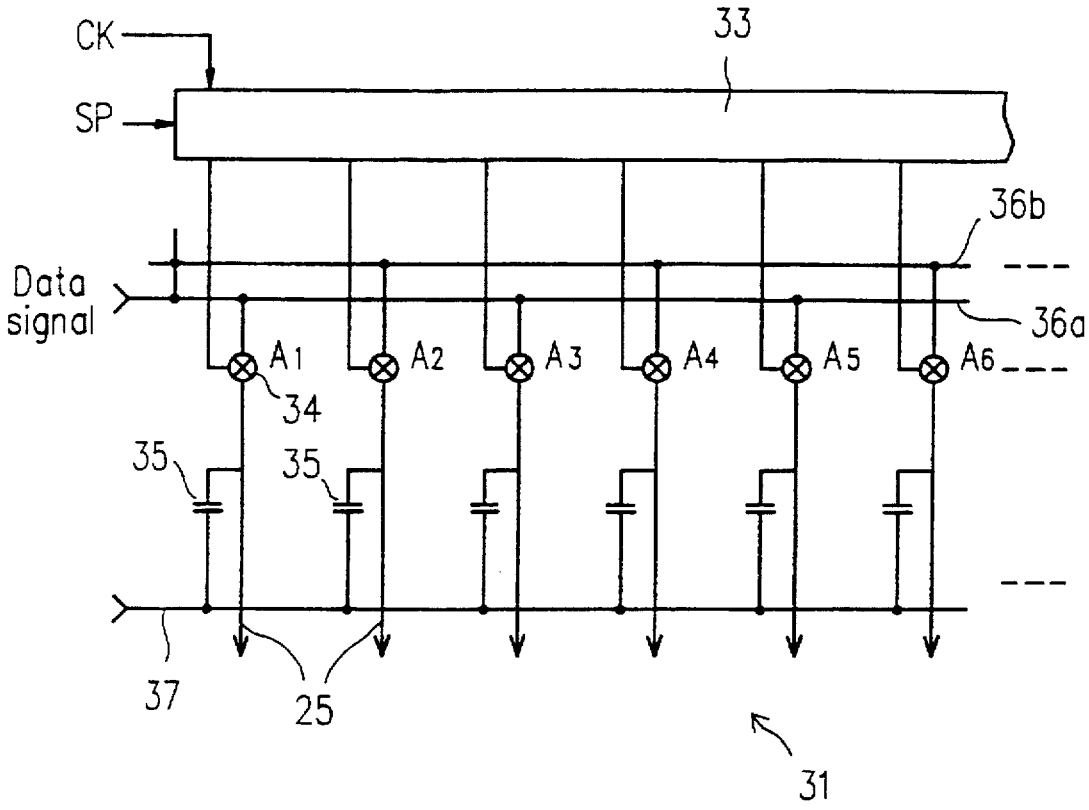
FIG. 11 is a block diagram showing an exemplary structure for a drive circuit of a liquid crystal display device in Example 2 according to the present invention.
Figure 12:
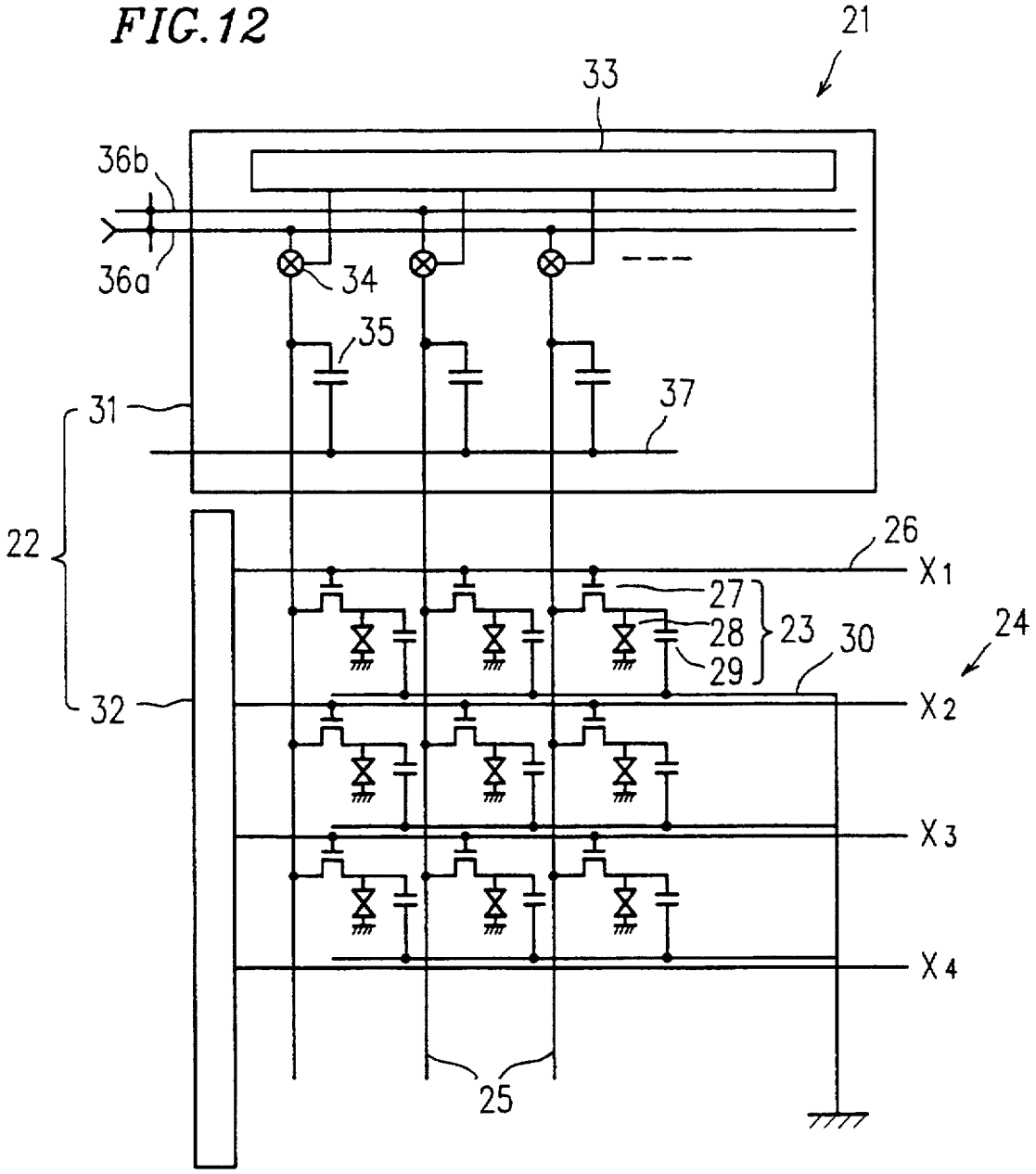
FIG. 12 is a block diagram showing the structure of the liquid crystal display device in Example 2 according to the present invention.

FIG. 11 is a block diagram showing an exemplary configuration of a source drive circuit 31 of a liquid crystal display device 21 in Example 2 according to the present invention. FIG. 12 is a block diagram showing a structure of the liquid crystal display device 21, and FIG. 13 is a cross-sectional view thereof.

The liquid crystal display device 21 includes a display portion 24 having a plurality of pixel portions 23 arranged in a matrix, and a drive circuit 22 for driving the display portion 24. In the display portion 24, a plurality of source bus lines 25 and a plurality of gate bus lines 26 perpendicular to the source bus lines 25 are formed. Each pixel portion 23 is provided in the vicinity of the crossed point of the source bus line 25 and the gate bus line 26. Each pixel portion 23 includes a TFT 27 connected to the source bus line 25 and the gate bus line 26, an LC capacitor 28, and a storage capacitor 29. One electrode of each storage capacitor 29 is connected to a storage capacitor common line 30. Each source bus line 25 is connected to a source drive circuit 31 provided in the drive circuit 22, and each gate bus line 26 is connected to a gate drive circuit 32 provided in the drive circuit 22.

The source drive circuit 31 includes a shift register 33, the source bus lines 25, a plurality of analog switches 34 as sampling means and source bus line additional capacitors 35. The shift register 33 shifts a start pulse SP input in the first storage cell to the adjacent storage cell in accordance with a clock signal CK input separately from the start pulse SP. A plurality of analog switches 34 (individually indicated by $A_1, A_2, A_3, \ldots$) are provided between a plurality of (two in Example 2) data signal branch lines 36*a* and 36*b*. The analog switches 34 function as a sampling circuit, that is, sample a data signal supplied from the data signal branch lines 36*a* and 36*b* to write it in each source bus line 25. Each source bus line additional capacitor 35 has an additional capacitor common line 37 as one electrode, and is provided between the additional capacitor common line 37 and the source bus line 25. The source bus line additional capacitor 35 holds data supplied to the source bus line 25. The output from each storage cell of the shift register 33 is input to each analog switch 34 as a sampling control signal. In the present example, the drive circuit 22 is formed together with a TFT array of the display portion 24 on an identical substrate so as to obtain a miniaturized display device.

Figure 13:
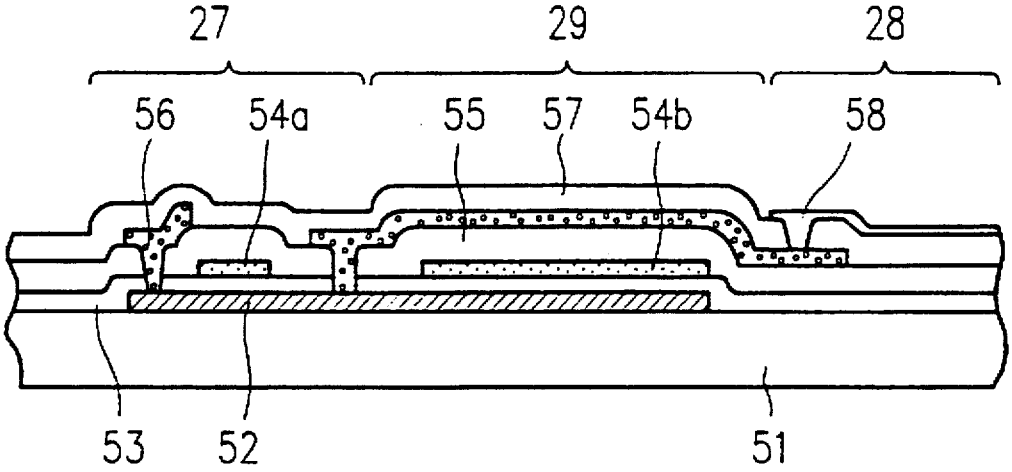
FIG. 13 is a cross-sectional view of the liquid crystal display device in Example 2 according to the present invention.

Referring to FIG. 13, a polycrystalline Si layer 52 functioning as a semiconductor active layer of the TFT 27 and a lower electrode of the storage capacitor 29, a gate insulating film 53, a polycrystalline Si layer 54 including a gate electrode 54*a* of the TFT 27 and an upper electrode 54*b* of the storage capacitor 29, a first interlayer insulator 55, a metal interconnecting layer 56 including a source electrode and a drain electrode of the TFT 27, and the other electrode of the storage capacitor 29, a second interlayer insulator 57, and a transparent conductive layer 58 functioning as a pixel electrode are formed and patterned on a substrate 51 in this order.

Figures 9A, 9B, 9C, 9D, 9E, 9F:
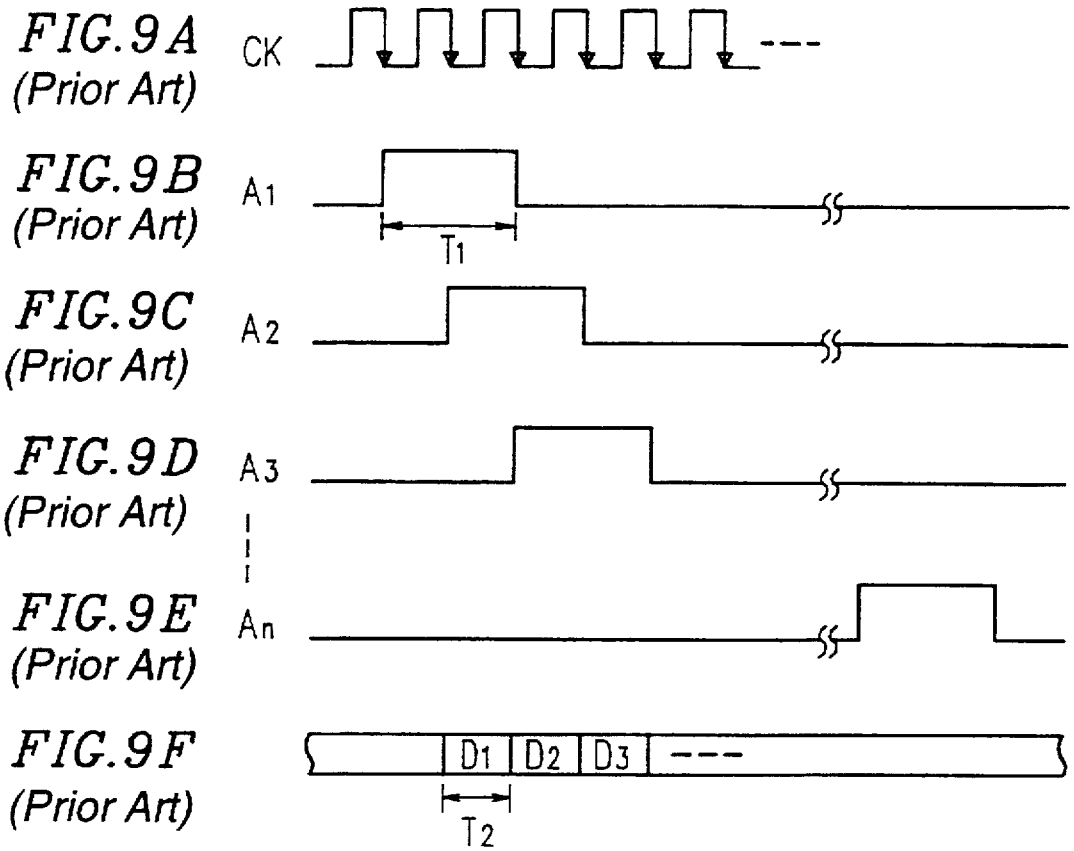
FIG.9A (Prior Art)
FIG.9B (Prior Art)
FIG.9C (Prior Art)
FIG.9D (Prior Art)
FIG.9E (Prior Art)
FIG.9F (Prior Art)
FIGS. 9A through 9F show timing diagrams illustrating the operations of examples according to the present invention and conventional examples.

The timing of the operation of the shift register 33 is the same as that of the above-mentioned conventional example (see FIGS. 9A through 9F). FIG. 9A shows the clock signal CK supplied to the shift register 33; sampling signals $A_1$ through $A_n$ of FIGS. 9B through 9E are outputs from the respective storage cells of the shift register 33; and FIG. 9F shows data supplied to the data signal line 25.

As shown in FIGS. 9A through 9F, the start pulse SP input in the first storage cell of the shift register 33 is shifted to the subsequent storage cell in accordance with a falling timing of the clock signal CK. In the present example, the output pulse length T1 of each storage cell is twice a period T2 allocated to sampling of the corresponding source bus line 25.

In the case where a usual display is performed, data written in the adjacent source bus lines 25 have a high correlation. Thus, a data signal is substantially precharged in each source bus line 25 by setting the period T1 longer than the period T2. Because of this, the parasitic capacitance of the source bus lines 25 and the write characteristics of a data signal written in the source bus line additional capacitor 35 of each source bus line 25 can be improved. Particularly, in a display device with high definition, the source bus lines increase in number in each display device to cause high density. This shortens the period allocated for sampling of each source bus line 25. For this reason, the present example has a structure effective for the improvement of a display quality. A data signal sampled by the analog switch 34 is held by the source bus line additional capacitor 35 of the source bus line 25, during which the data signal is written in the LC capacitor 28.

In the present example, two data signal branch lines 36*a* and 36*b* are used for supplying a data signal to the source drive circuit 31 from outside of the drive circuit 22. These two data signal branch lines 36*a* and 36*b* are provided in parallel with each other. The data signal branch lines 36*a* and 36*b* are alternately connected to the analog switches 34 of the source bus lines 25, that is, the data signal branch line 36*a* is connected to the 1st, 3rd, 5th, . . . source bus lines and the data signal branch line 36*b* is connected to the 2nd, 4th, 6th, . . . source bus lines counting from the side of the gate drive circuit 32. In each of the data signal branch lines 36*a* and 36*b*, one analog switch 34 is always opened. Therefore, the deformation of a data signal caused by precharging the subsequent source bus line can be prevented. In addition, since the source bus line additional capacitance of each source bus line becomes half, the deformation inherent to a data signal is also prevented.

EXAMPLE 3

Figure 14:
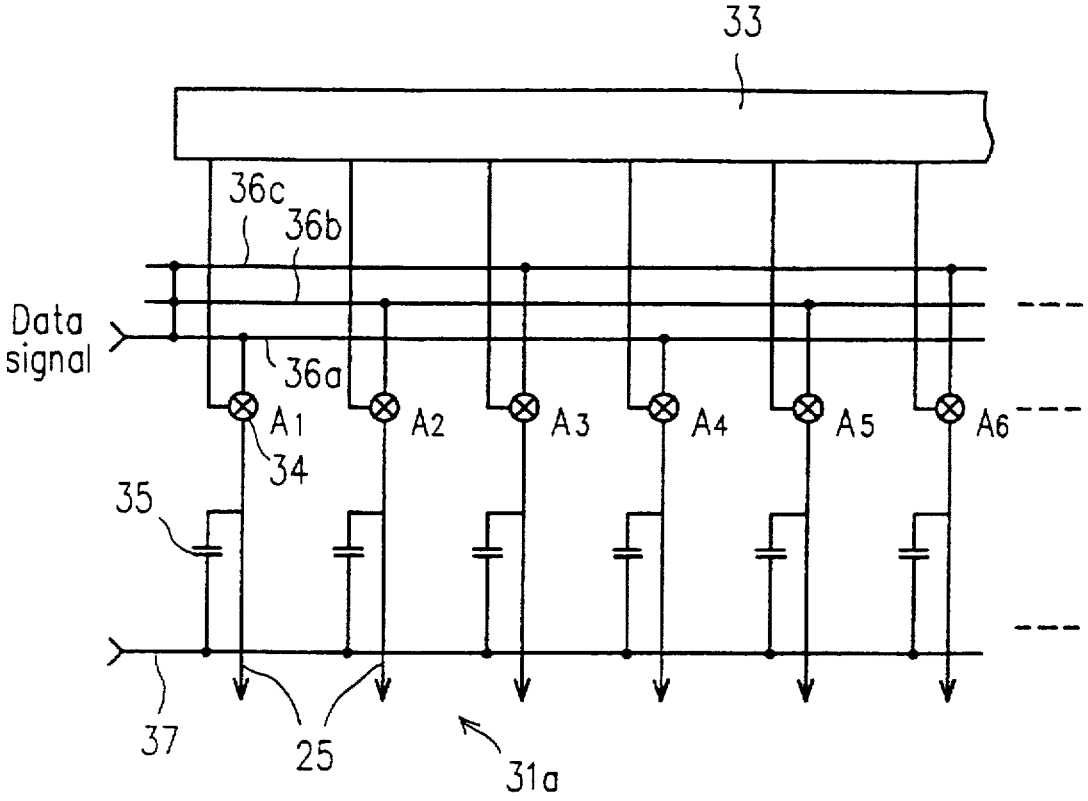
FIG. 14 is a block diagram of a drive circuit of the liquid crystal display device in Example 3 according to the present invention.

FIG. 14 is a block diagram of a source drive circuit 31*a* of a display device in Example 3 according to the present invention. The identical components to those of Example 2 bear the identical reference numerals thereof.

In the present example, the structure and drive method of the shift register 33 are the same as those of the display device 21 in Example 2. A data signal line 36 is branched into three branch lines (individually indicated by 36*a*, 36*b*, and 36*c*). The kth (k=1, 2, . . .) analog switch $A_k$ is connected to the data signal branch line 36*a*, the (k+1)th analog switch $A_{(k+1)}$ is connected to the data signal branch line 36*b*, and the (k+2)th analog switch $A_{(k+2)}$ is connected to the data signal branch line 36*c*.

Figure 15A:
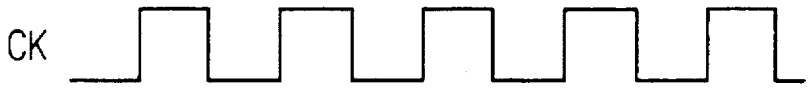
FIGS. 15A and 15B show a timing diagram illustrating the operation of an analog switch $A_k$.
Figure 15B:
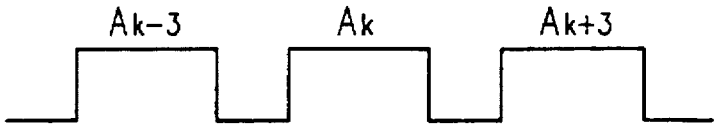

FIG. 15A shows the clock signal CK, and FIG. 15B shows the operation timing of the analog switch $A_k$ connected to one of the data signal branch lines 36*a*, 36*b*, and 36*c*. As is understood from FIGS. 15A and 15B, a half cycle after the analog switch $A_k$ of the kth source bus line 25 is closed, the subsequent analog switch, i.e., the (k+3)th analog switch connected to the identical data signal branch line is opened. Thus, the sampling of the kth source bus line 25 is not affected by the on/off control of the analog switches 34 on the data signal branch line 36*a* and the fluctuation of the electrical potential of the data signal branch lines 36*b* and 36*c*, enabling a satisfactory image.

EXAMPLE 4

Figure 16:
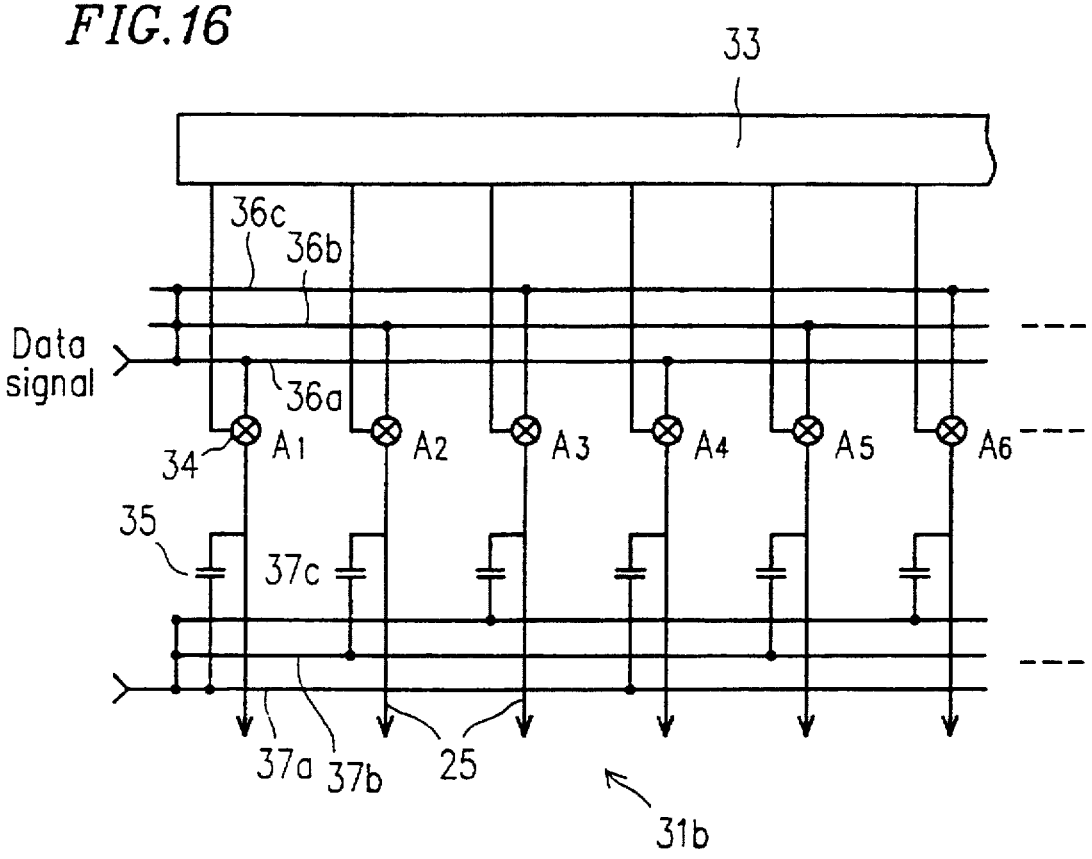
FIG. 16 is a block diagram of a drive circuit of a liquid crystal display device in Example 4 according to the present invention.

FIG. 16 is a block diagram of a source drive circuit 31*b* of a display device in Example 4 according to the present invention. The identical components to those in Examples 2 and 3 bear the identical reference numerals thereof.

In the present example, three data signal branch lines 36*a*, 36*b*, and 36*c* and three source bus line additional capacitor common branch lines 37*a*, 37*b*, and 37*c* are provided. The source bus line additional capacitor 35 corresponding to the kth analog switch $A_k$ (k=1, 2, . . .) is connected to the source bus line additional capacitor common branch line 37*a*, the source bus line additional capacitor 35 corresponding to the (k+1)th analog switch $A_{(k+1)}$ is connected to the source bus line additional capacitor common branch line 37*b*, and the source bus line additional capacitor 35 corresponding to the (k+2)th analog switch $A_{(k+2)}$ is connected to the source bus line additional capacitor common branch line 37*c*.

When a certain analog switch $A_k$ is opened, the electrical potential of the corresponding source bus line 25 is fluctuated. But, the time constants of the source bus line additional capacitor common branch lines 37*a*, 37*b*, and 37*c* are not sufficiently small compared with the period required for this fluctuation. Therefore, the electrical potential of the source bus line additional capacitor common branch lines 37*a*, 37*b*, and 37*c* are also locally fluctuated. This local fluctuation adds to that of the electrical potential of the source bus lines 25 through the source bus line additional capacitors 35. As described above, this fluctuation causes a ghost phenomenon in a display image. However, in the present example, such a ghost phenomenon can be prevented by providing a plurality of source bus line additional capacitor common branch lines 37*a*, 37*b*, and 37*c*.

In Example 3, the number of analog switches 34 which are simultaneously turned on is two, In the present example, three analog switches 34 are simultaneously turned on since three data signal branch lines 36*a*, 36*b*, and 36*c* are provided, and the sampling interval in each of the data signal branch lines 36*a*, 36*b*, and 37*c* is made a half cycle of the clock signal CK. Moreover, even though the data signal line 36 or the source bus line additional capacitor common line 37 is further branched and the sampling interval is enlarged, the same effects can be obtained. Furthermore, even in the case where only one analog switch 34 is turned on at a time, image quality can be improved by the branched structure of the data signal line 36 or the source bus line additional capacitor common line 37.

EXAMPLE 5

Figure 17:
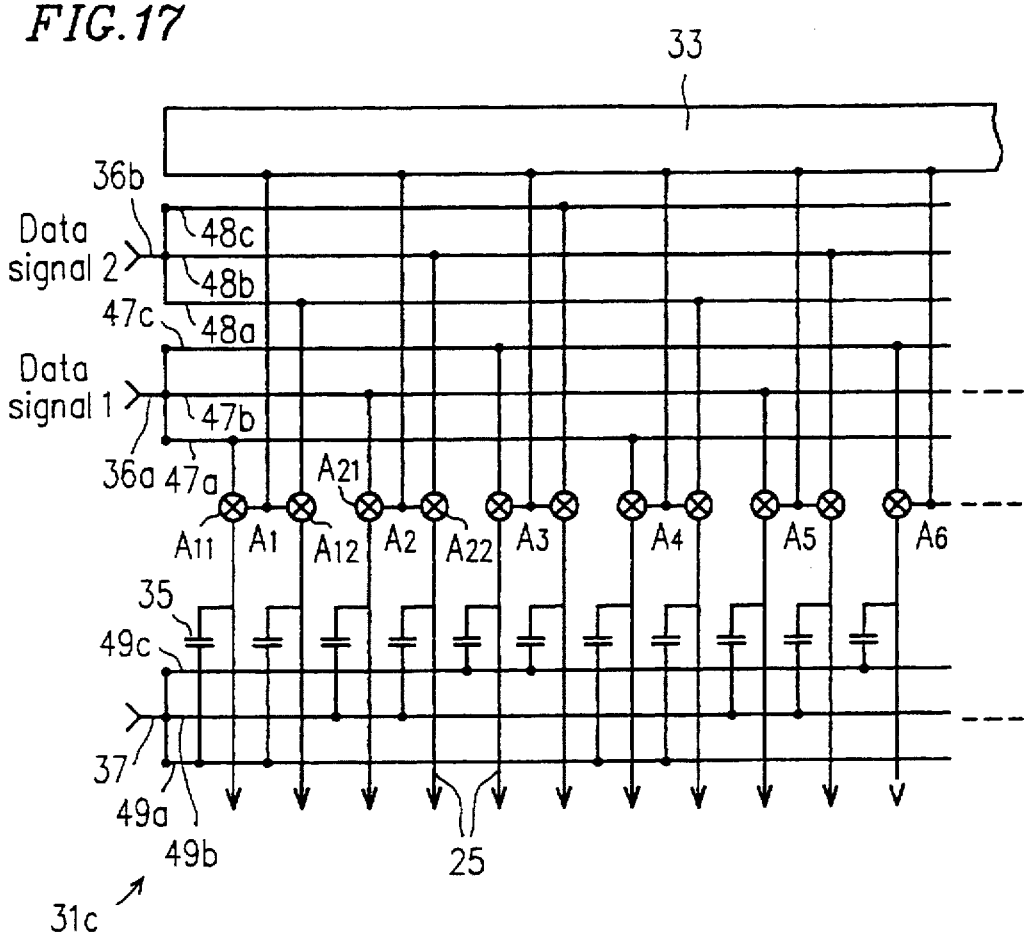
FIG. 17 is a block diagram of a drive circuit of a liquid crystal display device in Example 5 according to the present invention.

FIG. 17 is a block diagram of a source drive circuit 31*c* of a display device in Example 5 according to the present invention. The identical components to those in Examples 2, 3, and 4 bear the identical reference numerals thereof.

In the present example, a data signal line 36*a* which receives a data signal 1 is branched into three branch lines 47*a*, 47*b*, and 47*c*. A data signal line 36*b* which receives a data signal 2 is branched into three branch lines 48*a*, 48*b*, and 48*c*. A source bus line additional capacitor common line 37 is also branched into three branch lines 49*a*, 49*b*, and 49*c*.

The respective two adjacent analog switches 34 are combined as one group. An analog switch $A_{11}$ included in an analog switch $A_1$ is connected to the data signal branch line 47*a*, and a source bus line additional capacitor 35 connected to the analog switch $A_{11}$ is connected to the source bus line additional capacitor common branch line 49*a*. An analog switch $A_{12}$ included in the analog switch $A_1$ is connected to the data signal branch line 48*a*, and a source bus line additional capacitor 35 connected to the analog switch $A_{12}$ is connected to the source bus line additional capacitor common branch line 49*a*. An analog switch $A_{21}$ included in another analog switch $A_2$ is connected to the data signal branch line 47*b*, and a source bus line additional capacitor 35 connected to the analog switch $A_{21}$ is connected to the source bus line additional capacitor common branch line 49*b*. An analog switch $A_{22}$ included in the analog switch $A_2$ is connected to the data signal branch line 48*b*, and a source bus line additional capacitor 35 connected to the analog switch $A_{22}$ is connected to the source bus line additional capacitor common branch line 49*b*.

In the present example, the sampling signal supplied to analog switch $A_k$ from the shift register 33 simultaneously controls an on/off of the analog switches $A_{k1}$ and $A_{k2}$ of two source bus lines 25. Data signals are supplied to these two analog switches $A_{k1}$ and $A_{k2}$ from the two data signal branch lines 47*a* and 48*a*, respectively.

Because of the above-mentioned structure, the source drive circuit 31*c* of the present example has advantages that the drive frequency of the shift register 33 is decreased to a half, and the sampling period of the analog switches 34 is increased to double. In this structure, each of the data signal lines 36*a* and 36*b* are branched into three lines, and the on/off state of the analog switches 34 on one p art of the data signal lines 36*a* or 36*b* is selected as shown in FIGS. 15A and 15B. Alternatively, the source bus line additional capacitor common line 37 can be branched into two lines and connected to the source bus line additional capacitor 35 for each analog switch 34 so as to correspond to the respective two data signal branch lines of the data signal lines 36*a* and 36*b*.

The above-mentioned structure an improve the image quality in the same way as in the other examples.

Alternatively, shift registers with different drive shifts are provided in parallel with each other, and a logical sum of the outputs of the shift registers is obtained, thereby simultaneously turning on a number of analog switches to improve sampling characteristics of the analog switches. Even in this case, when 8 analog switches are simultaneously opened, image quality can be improved for the above-mentioned reasons by dividing the source bus line additional capacitor common line into 10 parts.

Even in the case where the polarity of display data is inverted per horizontal scanning line in the above-mentioned examples, a display with less signal delay and a ghost image can be obtained. The reasons for this are as follows:

In the present example, for preventing flickering, the polarity of a data signal is inverted per horizontal scanning line. As described above, data signal line 36*a* is branched into the three branch lines 47*a*, 47*b* and 47*c*, and the analog switches $A_k$ which are connected to one of the branch lines are selected in accordance with a timing signal shown in FIG. 15B. The analog switches $A_k$ connected to one of the branch lines are selected sequentially with an interval which is equal to one third of the period of the timing signal. Therefore, in the case where a data signal of the present horizontal scanning period is written to kth source bus line 25 while the electric potential of the k+3th source bus line is that of the data signal of the previous horizontal scanning period, the electric potential of the data signal for kth source bus line in the present horizontal scanning period is not affected by the data signal of the previous horizontal scanning period.

Accordingly, even in the case where a data signal with a polarity opposite to that of the electrical potential of the data signal for the previous horizontal scanning line is written, the electric potential of the data signal for the present horizontal scanning line is not affected by the previous data signal for the previous horizontal scanning line. As a result, according to the present example, a display in which the flickering phenomenon is prevented without causing a ghost image is obtained.

In FIGS. 9A through 9F, the falling edge of the sampling signal $A_k$ is synchronized to the rising edge of the sampling signal $A_{k+2}$. However, if a signal is deformed therebetween, the sampling signals $A_k$ and $A_{k+2}$ have a overlapped portion in terms of time. In the present example, even in such a case, the kth analog switch 34 and the (K+2)th analog switch are connected to different data signal lines, so that the (k+2)th analog switch 34 is turned on and the local electrical potential of the data signal line 36 is prevented from being affected by a data signal to be input to the source bus line 35 in the previous horizontal scanning period. Thus, the occurrence of a ghost image can be prevented in an actual display, and image quality can be improved.

EXAMPLE 6

Figure 18:
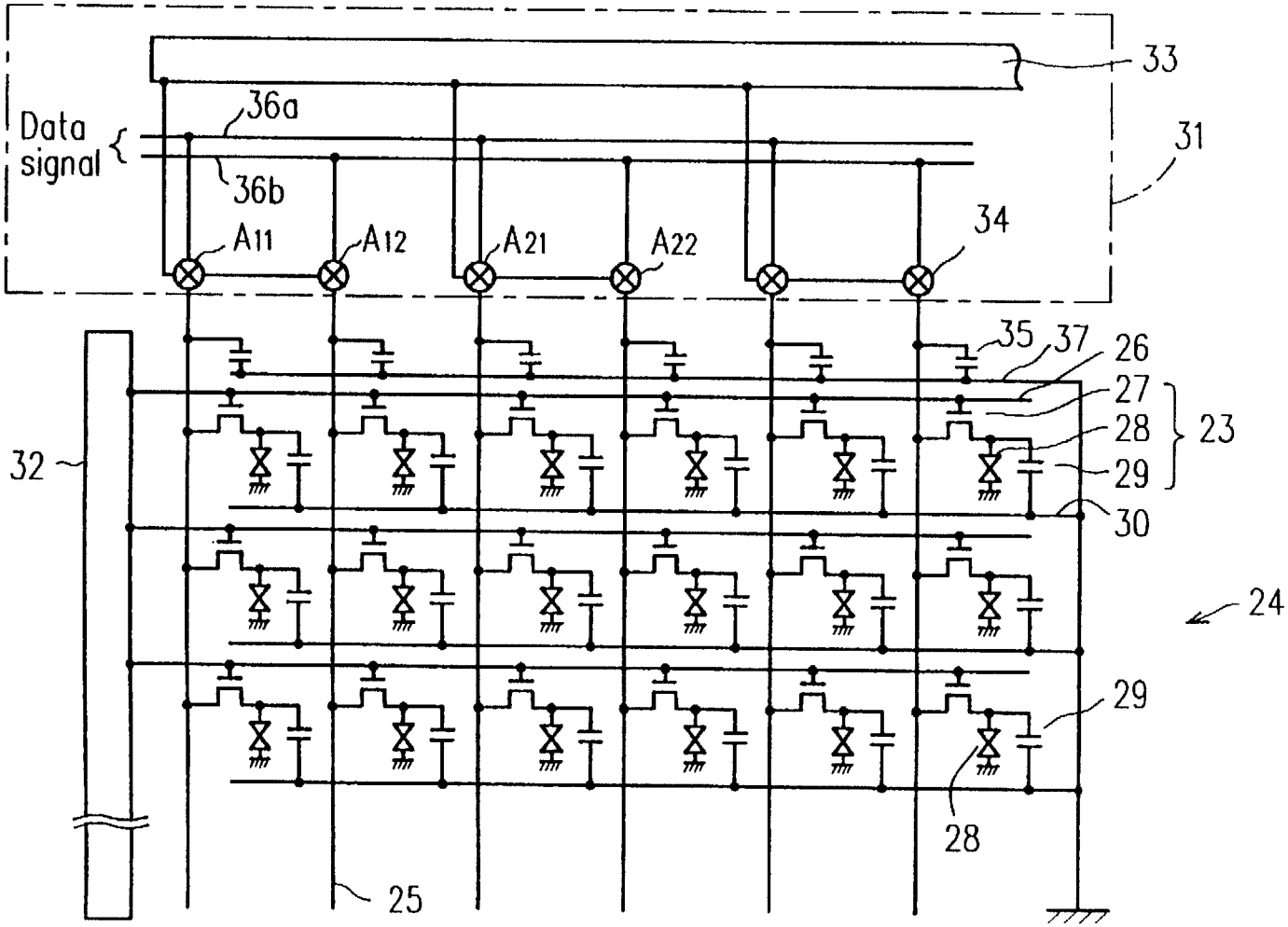
FIG. 18 is a block diagram showing a structure for the liquid crystal display device in Example 6 according to the present invention.

FIG. 18 is a block diagram showing the structure of a display device in Example 6 according to the present invention. The identical components to those of the above-mentioned examples bear identical reference numerals.

In the present example, the structure of a display portion 24 including a TFT array is the same as that of the above-mentioned examples, and thus the description thereof will be omitted here. The cross-section of the display device of the present example is the same as that shown in FIG. 13.

Referring to FIG. 13, a polycrystalline Si layer 52 functioning as a semiconductor active layer of the TFT 27 and a lower electrode of the storage capacitor 29, a gate insulating film 53, a polycrystalline Si layer 54 including a gate electrode 54*a* of the TFT 27 and an upper electrode 54*b* of the storage capacitor 29, a first interlayer insulator 55, a metal interconnecting layer 56 including a source electrode and a drain electrode of the TFT 27, and the other electrode of the storage capacitor 29, a second interlayer insulator 57, and a transparent conductive layer 58 functioning as a pixel electrode are formed and patterned on a substrate 51 in this order.

In FIG. 18, two data signal lines 36a and 36b are provided in a data drive circuit 31. A sampling signal controlling the timing of sampling of analog switches $A_{11}$ and $A_{12}$ output from the shift register 33 are input to the analog switches $A_{11}$ and $A_{12}$, respectively. Thus, in the present example, a data signal is simultaneously written from two data signal lines 36a and 36b to two adjacent data lines 25 through the analog switches $A_{11}$ and $A_{12}$. It is assumed that two data signals to be simultaneously written have a positive polarity and a negative polarity, respectively.

As described above, signals with different polarities are input to two data signal lines 36a and 36b. As a result, data signals simultaneously written in two source bus lines 25 have polarities inverted from each other. By performing this drive, charges corresponding to the signals written in two source bus lines 25 are partially canceled in the source bus line additional capacitor common line 37, so that the load of a signal transmission on the source bus line additional capacitor common line 37 is decreased. Thus, the improvement of display characteristics which is the same as that obtained by decreasing the resistance of the source bus line additional capacitor common line 37 to minimize the time constants of the signal delay can be obtained.

In the case where a monochromic display is performed in the display device of the present example, since the data in the adjacent pixel portions 23 are highly correlated with each other, the charges corresponding to the data signals with inverted polarities simultaneously sampled are canceled with a higher ratio on the storage capacitor common line 30 and the source bus line additional capacitor common line 37 performing a sampling and holding operation, compared with the case where a color display is performed by a liquid crystal display panel. Thus, in the case where a monochromic display is performed in the present example, a great effect of the improvement of the display characteristics can be obtained. This effect can be obtained in the same way even when a monochromic display is performed in each panel of the projection type liquid crystal display apparatus using three liquid crystal display panels.

In a display device having 600 or more pixels in a horizontal direction, the parasitic capacitance of the wiring is increased and the degree of a signal delay is increased in proportion with the number of pixels in the horizontal direction. According to the present invention, particularly remarkable improvement of display characteristics can be obtained in the display device having 600 or more of pixels in the horizontal direction.

EXAMPLE 7

Figure 19:
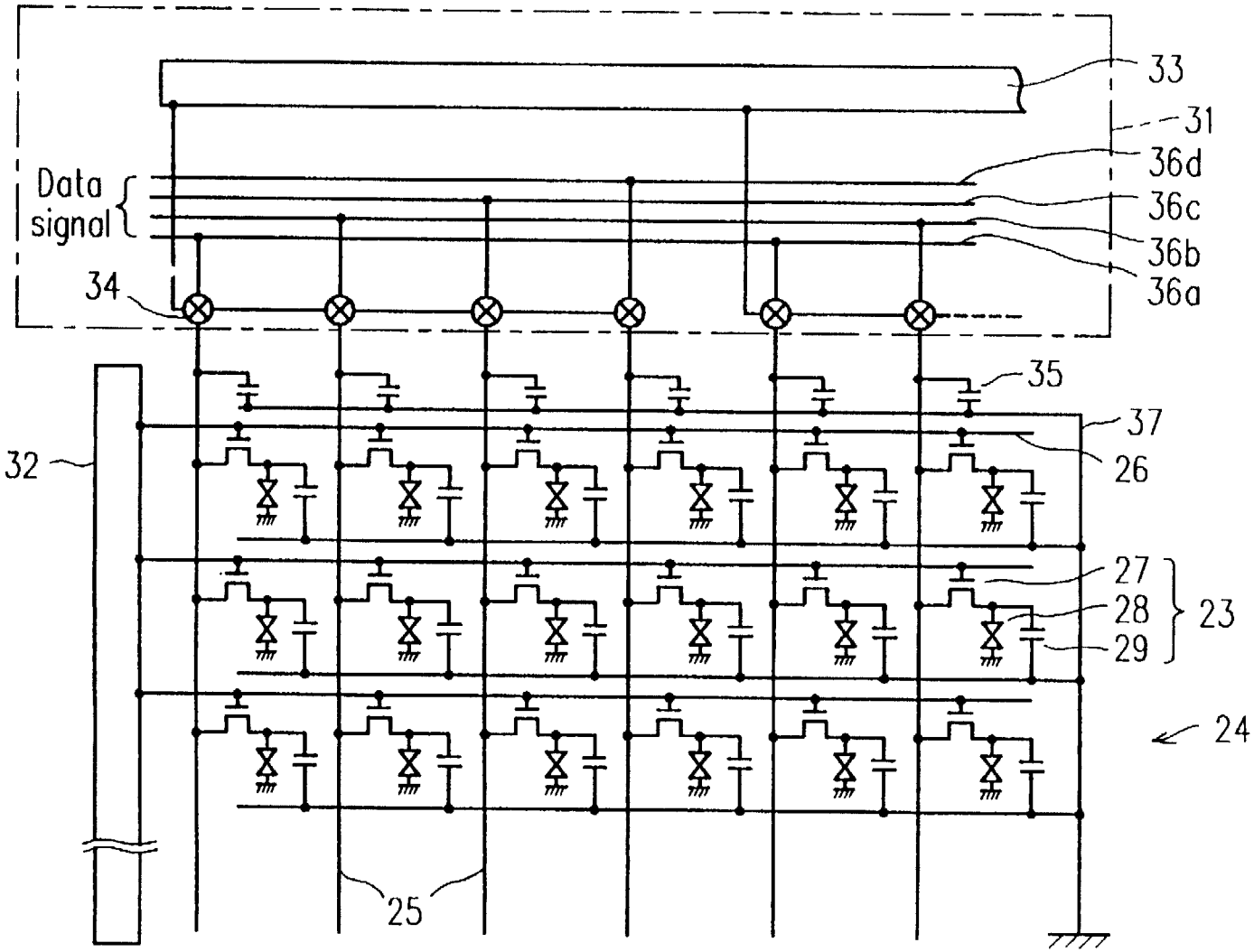
FIG. 19 is a block diagram showing a structure for the liquid crystal display device in Example 7 according to the present invention.

FIG. 19 is a block diagram showing the structure of a display device in Example 7 according to the present invention. The identical components to those in the above-mentioned examples bear the identical reference numerals thereof.

In the present example, a sampling signal output from the shift register 33 in the data drive circuit 31 simultaneously controls four analog switches 34. Thus, data signals output from four data signal lines 36a, 36b, 36c, and 36d are simultaneously input to four source bus lines 25. In this case, by making two of these data signals positive and the other two of these data signals negative, the written data signals are canceled with each other on the common lines and the effect of a signal delay can be minimized in the same way as in Example 6.

In the case where the polarities of the adjacent data signals are inverted, there are problems that bright points are increased in number. More specifically, referring to FIG. 19, when pixel electrodes of the LC capacitors 28 adjacent to each other in the horizontal direction are short-circuited, signals actually written in the LC capacitors 28 become an average of levels of the data signals with polarities inverted from each other, i.e., about 0 volts. In a liquid crystal display device using a normally white mode, this defect is indicated as high bright points, resulting in a remarkably degraded image quality. In contrast, according to the present example, in the case where the identical data signal is input to the adjacent pixel portions 23, bright points are hardly recognized since a signal similar to that to be displayed is input.

In order to solve the problem that high bright points are increased in number in the above-mentioned display device in a normally white mode to decrease yield, the following method for driving is used in the present example.

There are the following three combinations for canceling simultaneously sampled four kinds of data signals: (1234) =(++−−), (+−+−), and (+−−+), where the four source bus lines 25 are indicated by 1, 2, 3, and 4 in this order. (++−−) means that the source bus lines 1 and 2 have the same polarity and the source bus lines 3 and 4 have a polarity opposite to that of the source bus lines 1 and 2. The polarities of these source bus lines 25 are generally inverted per field, so that the combination (+−+−) is substantially identical to the combination (−+−+).

For example, in the case where a short circuit occurs between the pixel electrodes of the pixel portions 23 connected to the source bus lines 1 and 2, the combination (+−+−) or (+−−+) causes high bright points, however, the combination (++−−) does not cause bright points. Accordingly, the above-mentioned pixel defects can be prevented from becoming bright points by selecting the combination.

The most advantageous combination among the above-mentioned three combinations is selected depending upon the distribution of defects and production yield can be improved by using the selected combination.

Moreover, the combination of four source bus lines 25 to be simultaneously sampled is selected so that the number of defects be minimized, and a data signal corresponding to that combination is input to drive the display device. In this way, the display defects are further suppressed. Furthermore, the combination is changed for each part of the display portion under the condition that the distribution of defects in each combination is recognized, whereby problems due to pixel defects may be further suppressed.

As described above, the drive circuit of the display device according to the present invention includes the shift register sequentially outputting a control signal to the analog switches and the data signal lines connected to the source bus lines through the analog switches. Outputs from each storage cell of the shift register have an overlapped portion in terms of time, and a plurality of analog switches are simultaneously turned on to sample data from the identical data signal line. The data signal line is branched into a plurality of lines so that a plurality of analog switches connected to each data signal branch line are not simultaneously turned on. Because of this structure, the additional capacitance of each source bus line and the time constant of a signal delay are decreased, and the deformation of a waveform of data signal caused by precharging of the adjacent pixel is minimized. As a result, the resolution of a display image is improved.

Moreover, according to another aspect of the present invention, a satisfactory image quality with less ghost phenomenon an be realized by making the number of data signal branch lines larger than the number of simultaneously opened analog switches.

Furthermore, according to the present invention, the effect of the time constant of a wiring on a signal delay at a time when a signal is written is decreased, and the improvement of display characteristics can be exhibited particularly in a high definition display device. Although the above-mentioned structure has a problem in that bright points decrease yield, the selection of the combination of polarities of signals will solve the problem.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A liquid crystal display device comprising: a plurality of source bus lines in parallel with each other; a plurality of gate bus lines in parallel with each other, crossing the source bus lines; a switching element connected to one of the plurality of source bus lines and one of the plurality of gate bus lines; a pixel portion connected to the switching element; and a source drive circuit for supplying a data signal to the plurality of source bus lines, wherein the source drive circuit has a data signal line connected to the respective source bus lines, and the data signal line forms a closed circuit, thereby making a delay time of the data signal supplied to the plurality of source bus lines uniform.

2. A liquid crystal display device according to claim 1, wherein each of the plurality of source bus lines has a source bus line additional capacitor, and the data signal supplied to each source bus line by the source drive circuit is held by the source bus line additional capacitor and a parasitic capacitance of the source bus line.

3. A liquid crystal display device according to claim 2, wherein the source drive circuit comprises a shift register for sequentially outputting a sampling signal based on a clock signal supplied through a clock signal line and a plurality of sampling means for sampling a data signal based on the sampling signal to output the sampled data signal to each of the plurality of source bus lines, the respective source bus line additional capacitors are connected to a source bus line additional capacitor common line, and the clock signal line and the source bus line additional capacitor common line form closed circuits.

4. A liquid crystal display device according to claim 3, wherein a scanning direction of the shift register is changed between a forward direction and a reverse direction.

5. A liquid crystal display device according to claim 3, wherein at least two sampling means of the plurality of sampling means are turned on during an identical period.

6. A liquid crystal display device according to claim 3, further comprising means for adding an overshoot to a rising edge of a waveform of the data signal and an undershoot to a falling edge of the waveform of the data signal.

7. A liquid crystal display device according to claim 3, further comprising means for adjusting a phase difference between the data signal and the clock signal.

8. A projection type liquid crystal display apparatus comprising: a light source; three liquid crystal display devices; a first optical system for splitting light from the light source into three primary-color components to introduce the three primary-color components into the three liquid crystal display devices; and a second optical system for combining the respective components transmitted through the three liquid crystal display devices, each of the three liquid crystal display devices including: a plurality of source bus lines in parallel with each other; a plurality of gate bus lines in parallel with each other, crossing the plurality of source bus lines; a switching element connected to one of the plurality of source bus lines and one of the plurality of gate bus lines; a pixel portion connected to the switching element; and a source drive circuit for supplying a data signal to the plurality of source bus lines, the source drive circuit including a data signal line connected to the respective source bus lines and a shift register for sequentially outputting a sampling signal based on a clock signal supplied through a clock signal line and a plurality of sampling means for sampling a data signal based on the sampling signal to output the sampled data signal to each of the plurality of source bus lines, wherein the data signal line forms a closed circuit, thereby making a delay time of the data signal supplied to the plurality of source bus lines uniform, and a scanning direction of the shift register is changed between a forward direction and a reverse direction, and the scanning direction of one of the three liquid crystal display devices being opposite to the scanning direction of the other liquid crystal display devices.

9. A liquid crystal display device comprising:

a plurality of source bus lines in parallel with each other;

a plurality of gate bus lines in parallel with each other, crossing the source bus lines;

a switching element connected to one of the plurality of source bus lines and one of the plurality of gate bus lines;

a pixel portion connected to the switching element; and a source drive circuit for supplying a data signal to the plurality of source bus lines, wherein the source drive circuit includes a shift register for sequentially outputting a sampling signal and a plurality of sampling means for sampling the data signal based on the sampling signal to output the sampled data signal to each of the plurality of source bus lines, the source drive circuit includes a data line branched into a first branch line and a second branch line, the plurality of sampling means being grouped into a first group connected to the first branch line and a second group connected to the second branch line, each of the sampling means belonging to the same group is turned on during a different period and the number of data signal branch lines is larger than the number of sampling means which are simultaneously sampling.

10. A liquid crystal display device according to claim 9, wherein each of the plurality of source bus lines has a source bus line additional capacitor, and the data signal supplied to each source bus line by the source drive circuit is held by the source bus line additional capacitor and a parasitic capacitance of the source bus line.

11. A liquid crystal display device according to claim 10, wherein the data line further includes a third branch line, and the plurality of sampling means have the first group, the second group, and a third group connected to the third branch line.

12. A liquid crystal display device according to claim 10, wherein the plurality of sampling means belonging to different groups are turned on during an identical period.

13. A liquid crystal display device according to claim 10, wherein the source drive circuit supplies data signals with polarity alternately inverted for each gate bus line.

14. A liquid crystal display device according to claim 10, wherein the plurality of source bus line additional capacitors are connected to a source bus line additional capacitor common line, the source bus line additional capacitor common line having first and second branch source bus line additional capacitor common lines, and the plurality of source bus lines have a first group connected to the first branch source bus line additional capacitor common line and a second group connected to the second branch source bus line additional capacitor common line.

15. A liquid crystal display device according to claim 10, wherein the number of the groups of the sampling means is the same as the number of the groups of the source bus lines, and the source bus lines belonging to different groups are connected to the sampling means belonging to different groups.

16. A method for driving a liquid crystal display device comprising: a plurality of source bus lines in parallel with each other; a plurality of gate bus lines in parallel with each other, crossing the source bus lines; a switching element connected to one of the plurality of source bus lines and one of the plurality of gate bus lines; a pixel portion connected to the switching element; and a source drive circuit for supplying a data signal to the plurality of source bus lines, wherein the source drive circuit includes a shift register for sequentially outputting a sampling signal and a plurality of sampling means for sampling the data signal based on the sampling signal to output the sampled data signal to each of the plurality of source bus lines, an even number of sampling means simultaneously samples the data signal based on one sampling signal, thereby generating an even number of sampled data signals, the even number of sampled data signals are output to the plurality of source bus lines under a condition that polarity of at least one of the data signals of the even number of sampled data signals are made opposite to a polarity of other data signals of the even number of sampled data signals, and the source lines to which the at least one of the data signals of the even number of sampled data signals are outputted are predetermined such that the combination of the polarities of the even number of sampled data signals prevent bright point defects.

17. A method for driving a liquid crystal display device according to claim 16, wherein each of the plurality of source bus lines has a source bus line additional capacitor, and the data signal supplied to each source bus line by the source drive circuit is held by the source bus line additional capacitor and a parasitic capacitance of the source bus line, and the source bus line additional capacitors of the source bus lines connected to the even number of sampling means for simultaneous sampling based on the one sampling signal are connected to the same source bus line additional capacitor common line.

18. A method for driving a liquid crystal display device according to claim 16, wherein a combination of the polarity of the half of the data signals of the even number data signals simultaneously sampled based on the one sampling signal and the polarity of the other half of the data signals of the even number data signals is selected based on the number of defects caused in adjacent pixels.

19. A method for driving a liquid crystal display device according to claim 16, wherein a combination of the polarity of the half of the data signals of the even number of data signals simultaneously sampled based on the one sampling signal and the polarity of the other half of the data signals of the even number of data signal is the same with respect to all of the sampling signals.

20. A method for driving a liquid crystal display device according to claim 16, wherein a combination of the polarity of the half of the data signals of the even number of data signals simultaneously sampled based on the one sampling signal and the polarity of the other half of the data signals of the even number of data signals is selected based on the number of defects caused in adjacent pixels per sampling signal.

21. A method for driving a liquid crystal display device according to claim 16, wherein the liquid crystal display device is a monochromic display device.

22. A method for driving a liquid crystal display device according to claim 16, wherein the number of the plurality of pixels connected to each of the plurality of gate bus lines in the liquid crystal display device is at least 600.

23. A method for driving a liquid crystal display device as in claim 16, wherein the polarities of pairs of adjacent source lines are coincident.

24. A method for driving a liquid crystal display device as in claim 16, wherein the polarities of four adjacent source lines are selected from (++−−), (+−−+), and (−++−).

* * * * *